US008027491B2

(12) United States Patent
LeDonne

(10) Patent No.: US 8,027,491 B2
(45) Date of Patent: Sep. 27, 2011

(54) CONTACT SPEAKER

(75) Inventor: Robert D. LeDonne, Colorado Springs, CO (US)

(73) Assignee: Tactile Sound Systems, Inc., Colorado Springs, CO (US)

( * ) Notice: Subject to any disclaimer, the term of this patent is extended or adjusted under 35 U.S.C. 154(b) by 1240 days.

(21) Appl. No.: 11/714,068

(22) Filed: Mar. 5, 2007

(65) Prior Publication Data

US 2007/0217644 A1 Sep. 20, 2007

Related U.S. Application Data

(60) Provisional application No. 60/779,104, filed on Mar. 3, 2006, provisional application No. 60/810,378, filed on Jun. 2, 2006.

(51) Int. Cl.
*H04R 25/00* (2006.01)

(52) U.S. Cl. ..... 381/151; 381/162

(58) Field of Classification Search ..... 381/151, 381/152, 300, 163, 158, 162; 181/153, 161
See application file for complete search history.

(56) References Cited

U.S. PATENT DOCUMENTS

| | | | |
|---|---|---|---|
| 2,858,376 | A | 12/1958 | Lewis |
| 3,423,544 | A | 1/1969 | Weiss |
| 4,064,376 | A | 12/1977 | Yamada |
| 4,354,067 | A | 10/1982 | Yamada et al. |
| 4,757,548 | A | 7/1988 | Fenner, Jr. |
| 4,778,027 | A | 10/1988 | Taylor |
| 4,961,227 | A | 10/1990 | LeDonne |
| 4,961,277 | A | 10/1990 | Rosenbaum |
| 5,125,031 | A | 6/1992 | Ledonne |
| 6,544,165 | B1 | 4/2003 | McNew |
| 6,733,464 | B2 | 5/2004 | Olbrich et al. |
| 2005/0244029 | A1 | 11/2005 | Takayama et al. |

OTHER PUBLICATIONS

International Search Report, International application No. PCT/US2007/005615, filed on Mar. 5, 2007, report issued on Sep. 18, 2008, 4 pages.

*Primary Examiner* — Tuan D. Nguyen
(74) *Attorney, Agent, or Firm* — Patterson Thuente Christensen Pedersen, P.A.

(57) ABSTRACT

A tactile sound speaker transmits sound-generated vibrations to a user through a touchpad to provide a tactile sound experience. The tactile sound speaker can include a speaker driver, a speaker cone, and a touchpad. The touchpad can be coupled to the speaker cone by transmission shafts that transmit vibrations generated by the speaker driver's output. A user may experience tactile sound by contacting the touchpad with a hand, foot, or other body part while listening to music or other sound.

19 Claims, 28 Drawing Sheets

CONTACT SPEAKER

PRIORITY CLAIM

The present application claims priority to U.S. Provisional Application Ser. No. 60/779,104, filed Mar. 3, 2006, and entitled, "IMPROVED CONTACT SPEAKER", and U.S. Provisional Application Ser. No. 60/810,378, filed Jun. 2, 2006, and entitled, "IMPROVED CONTACT SPEAKER", both of which are herein incorporated by reference in their entirety.

FIELD OF THE INVENTION

The present invention relates generally to speakers. More particularly, the present invention relates to a speaker system that transmits sound-generated vibrations to a user contact portion to provide a tactile sound experience.

BACKGROUND OF INVENTION

Loudspeaker drivers typically include the following components: an electromagnet, a moving voice coil, and a speaker cone attached to the coil. The speaker driver components operate together to generate audible sounds, such as music or voice transmissions. The electromagnet receives sound transmissions in the form of electrical signals from a sound amplifier, and the variations in the signal frequency and amplitude cause the magnetic flux of the magnet to change in response thereto. The vibrating voice coil and a sound conversion component, such as a speaker cone, are responsive to the changes in magnetic flux and move in a manner characteristic of the frequency and amplitude of the signal.

The speaker cone is the component that is responsible for converting the electrical signals into audible sound. The movement of the speaker cone displaces the air in the vicinity of the speaker cone. The displaced air creates sound waves having amplitudes and frequencies indicative of those from the electrical signal, and in this manner the desired audible sound reproduction is achieved.

The speaker drivers are typically enclosed in a sturdy, non-vibrational housing. The electromagnet and voice coil are recessed into the housing, and the face of the speaker cone is generally focused outward from the housing to direct the audible sound outward into the listening area. A perforated grill made of a rigid material, such as plastic or metal, or an acoustically transparent foam is placed over the exposed surface of the speaker cone for protection.

It is known in the audio reproduction arts that the transmission of vibrations to the body intensifies the enjoyment of listening to music. For example, in U.S. Pat. Nos. 4,064,376 and 4,354,067, which are herein incorporated by reference in their entirety, two devices for the implantation of a vibration device within a seat and backrest, respectively, of a chair are disclosed. The audio sensation created by the vibrations transmitted through the body cavity of the person sitting in the chair intensifies the enjoyment of the music. In U.S. Pat. No. 4,757,548, which is herein incorporated by reference in its entirety, a speaker that transmits sonic vibrations to liquid and solid media is disclosed. U.S. Pat. No. 4,778,027, which is herein incorporated by reference in its entirety, teaches the placement of speakers faced toward a surface to be vibrated. During operation, the sonic energy generated by the speaker is transmitted to the surface, causing the surface to vibrate.

It is also known in the audio reproduction arts to use sound induced vibrations to aid the hearing impaired. In U.S. Pat. Nos. 3,423,544 and 2,858,376 respectively, each of which is herein incorporated by reference in their entirety, two electro-acoustic bone conduction receivers mounted onto the elongated portion of eye glasses are disclosed. The bone conduction receiver as described in these references is an electromechanical device that transforms electric currents into mechanical vibrations and transmits the latter to the bones of the skull of the wearer of the glasses in the vicinity of the ear. This process of transmitting sounds to the inner ear of a deaf person is known to give good results in many instances where the inner ear is in reasonably good condition, although the middle ear may be seriously defective.

In U.S. Pat. Nos. 4,961,227 and 5,125,031, each of which is herein incorporated by reference in their entirety, loud speaker systems for transmitting vibrations are disclosed that include a speaker cone, a propagation member, and a housing that encloses the speaker cone and the propagation member. Generally, the vibrations on the speaker cone are transmitted to the housing through the propagation member. In some embodiments, the propagation member can extend through the housing or can include a vacuum environment within the housing.

In some settings, it is desirable that the vibrations from a loudspeaker be directly felt by a human body in more accurate and focused fashion. For example, the human body's feeling of the vibrations generated by music can be used to convey rhythm, timing, and steps to the deaf. In another example, when a person listens to music, the body feeling towards vibrations of the loud speaker enables the person to sense how hard and how quick the player strikes the keys of a piano. In some other settings, in addition to the requirements of more accurate and focused vibration transmission, it is also desirable to transmit the vibrations from the loudspeaker to the human body without transmitting audible sounds from the loud speaker. For example, loud speakers can be installed in a chair so a person sitting in the chair can feel the vibrations without disturbing others.

SUMMARY OF THE INVENTION

The present invention is directed to an improved apparatus for transmitting audio generated vibrations to a user's body. In particular, one embodiment of the invention is directed to a speaker system that transmits sound-generated vibrations to a user contact portion to provide a tactile sound experience. In one embodiment, the speaker system comprises a speaker driver, a speaker cone, and a touchpad. The touchpad is coupled to the speaker cone by transmission shafts that transmit vibrations generated by the speaker driver's auditory output. A user experiences tactile sound by contacting the touchpad with a hand, foot, or other body part while listening to music or other sound.

In one aspect of the present disclosure, a tactile speaker can comprise a speaker driver, a speaker cone, a touchpad and at least one vibration transmitter shaft operably mounted between the speaker cone and the touchpad. In some embodiments, the tactile speaker can be mounted within a speaker housing. The tactile speaker can mounted within an object such as, for example, furniture and children's toys, to communicate audio and corresponding vibrational transmissions. In one representative embodiment, the tactile speaker can be operably mounted on a prosthesis for providing vibrational transmissions to a patient's body. In some embodiments, the tactile speaker can include a plurality of touchpads such they can simultaneously used at various portions of a user's body, such as, for example, a hand and foot or alternatively, to provide a left-right stereo transmission. The tactile speaker can further include a prophylactic covering the touchpad such that multiple users can use the touchpad without risk of infection and/or contamination through the touchpad.

In another aspect of the present disclosure, a method of communicating vibrational transmissions corresponding to an audio output can comprise providing a tactile sound speaker having a speaker driver, a speaker cone, at least one vibration transmitter shaft and at least one touchpad wherein a sound generated by the speaker driver is transmitted as vibrations to the touchpad through the at least one vibration transmitter shaft such that user can interface with the touchpad to feel the vibrations. The method can further comprise muting the sound such that the only output transmitted are the vibrations through the touchpad. The method can further comprise embedding the tactile sound speaker touchpad within an object such as, for example, a piece of furniture, a toy and a game. In some embodiments, the method can further comprise encasing the touchpad within a removable prophylactic so as to allow for use by multiple users in a clinical or therapeutic environment. In some embodiments, the tactile sound speaker can be attached to a prosthesis.

In another aspect of the present disclosure, a touchpad for communicating vibrations originating as sound generated by a speaker driver. In some embodiments, the touchpad can include a heating element and/or an optic device such as a laser or LED. In some representative embodiments, the touchpad can include a textured surface having raised and/or recessed portions or be molded to a user's hand or foot to improved the fit. In some representative embodiment, the touchpad can include a plurality of tactile or sensory zones to provide specific inputs to a user.

In yet another aspect of the present disclosure, a prosthesis can include a tactile sound speaker for transmitting vibrations to a user. In some embodiments, the tactile sound speaker can be oriented in a side mount configuration wherein the touchpad is in contact with the prosthesis wall or alternatively, directly to the user. In some embodiments, a vibration transmitter shaft can operably interconnect a speaker cone and the prosthesis wall such that that prosthesis wall functions as a touchpad. In some embodiments, the speaker cone can be sculpted to have formed cones of differing heights so as to accommodate the particular size and shape of the prosthesis.

The above summary of the invention is not intended to describe each illustrated embodiment or every implementation of the present invention. The Figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
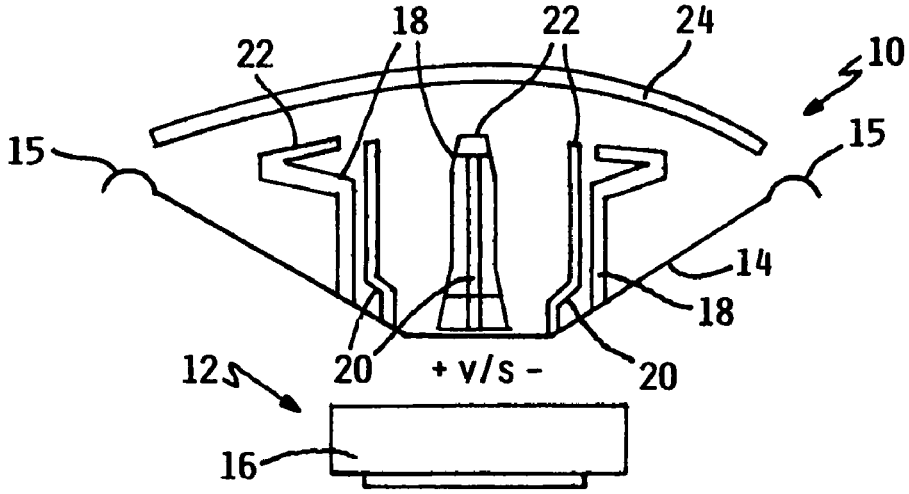
FIG. 1 is a side view of a tactile sound speaker according to one embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Figure 2:
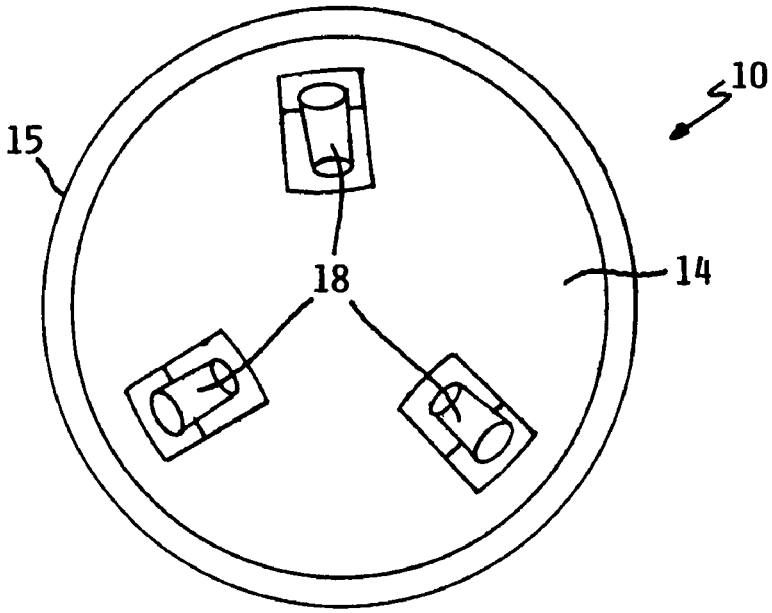
FIG. 2 is a top view of the tactile sound speaker of FIG. 1.

Referring to FIGS. 1 and 2, a speaker 10 comprises a speaker driver 12 and a speaker cone 14. Speaker 10 is typically mounted in a housing (not shown), and a rubber gasket 15 is adapted to couple speaker cone 14 to the housing. Speaker driver 12 comprises a magnet 16.

According to the present invention, speaker 10 further comprises at least one vibration transmitter shaft 18 mounted on, affixed to, or otherwise coupled with speaker cone 14. In one embodiment, each transmitter shaft 18 is glued to the inner surface of speaker cone 14. In another embodiment, transmitter shafts 18 are molded to or contiguously formed with a touchpad 24, which is described in more detail below. As depicted in FIGS. 1 and 2, speaker 10 comprises three transmitter shafts 18, each defining a hollow core 20 there through and an upper portion 22. Other configurations and arrangements of transmitter shafts 18 can be used in other embodiments of the invention, some of which are described in more detail below. In particular, more or fewer transmitter shafts 18 can be used, as well as solid core transmitter shafts 18. Transmitter shafts 18 can comprise a variety of materials, including crystal, metal, glass, nylon and any of a variety of suitable plastics. A material of transmitter shaft(s) 18 may be selected for reverberation and amplification properties exhibited in transferring sound to vibration when used with a specific speaker 10 or for a particular application. For example, one material may be preferred on speakers 10 of smaller or larger size, or for playback of music or other sound that is more treble-intense or more base-intense.

Upper portions 22 of transmitter shafts 18 couple each transmitter shaft 18 to a touchpad 24. Upper portions 22 are therefore physically adapted to be glued, fastened, affixed, attached, or otherwise coupled, removably or permanently, to touchpad 24. As described above with regard to the material and general configuration of transmitter shafts 18, the shape and structure of upper portions 22 can vary from that depicted in FIGS. 1 and 2 in other embodiments of the invention.

Figure 3A:
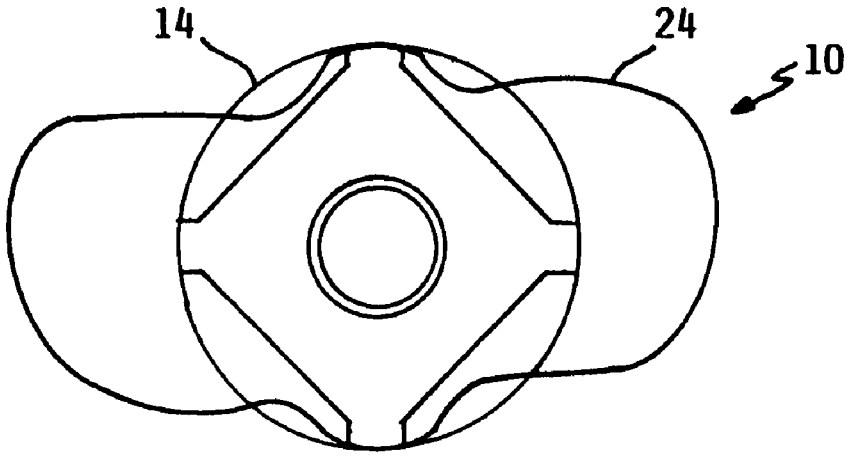
FIG. 3A is a top view of a tactile sound speaker according to another embodiment of the invention.
Figure 3B:
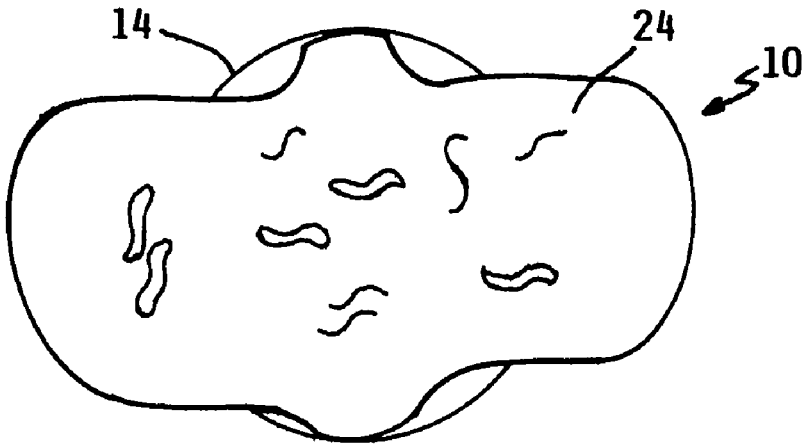
FIG. 3B is a top view of the tactile sound speaker of FIG. 3A.
Figure 3C:
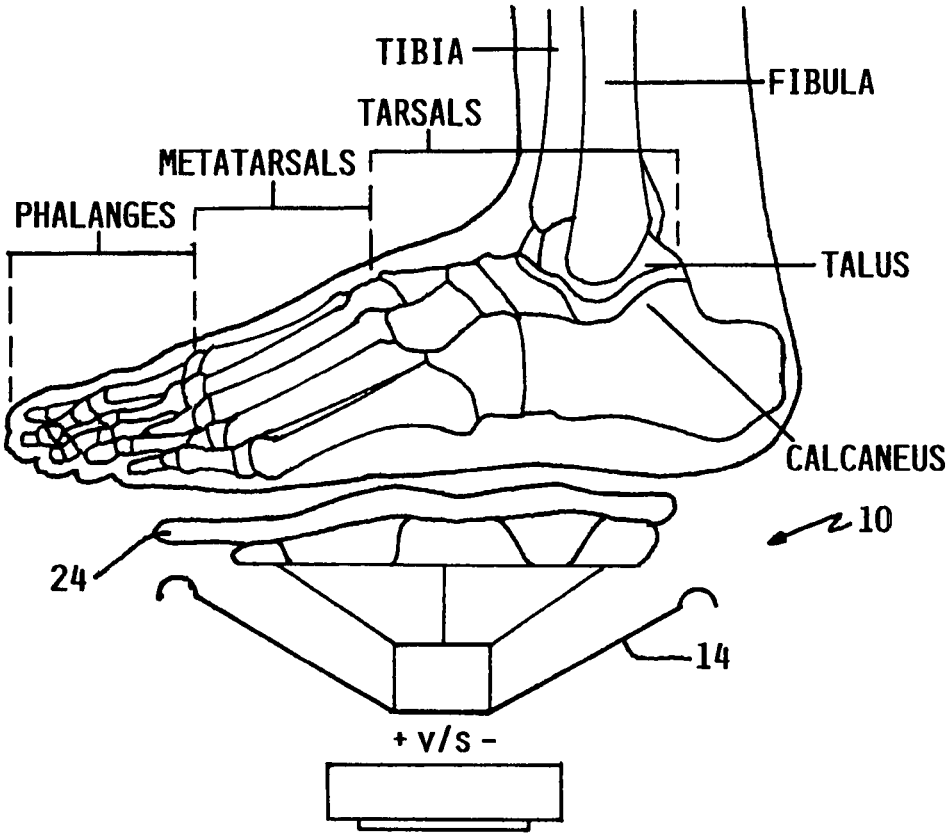
FIG. 3C is a side view of the tactile sound speaker of FIG. 3A interfacing with a user's foot.

Touchpad 24 is configured to transfer to a user vibrations originating as sound generated by speaker driver 12 and transmitted by transmitter shafts 18. In one embodiment as illustrated in FIGS. 3A, 3B and 3C, touchpad 24 an comprise a curved surface on which a user places a hand or foot. Touchpad 24 can comprise plastic, metal, crystal, glass, or some other material, and in various embodiments can be covered with fabric or coated with a tactilely pleasing layer to facilitate comfort or provide an aesthetically pleasing look and feel so long as vibration transmission or speaker 10 sound are not dampened. In other embodiments, removable and replaceable, or washable, covers may be fitted over touchpad 24 for use in clinical or therapeutic environments in which many users utilize a single speaker 10. Touchpad 24 itself may be removably coupled to transmitter shafts 18, facilitating cleaning or replacement. For example, a single speaker 10 could include a plurality of differently configured touchpads 24, a first touchpad 24 adapted to comfortably support a user's hand during use, a second touchpad 24 adapted for a user's foot, and additional touchpads 24 having alternate configurations or compositions to facilitate multiple uses and applications of speaker 10.

Figure 4A:
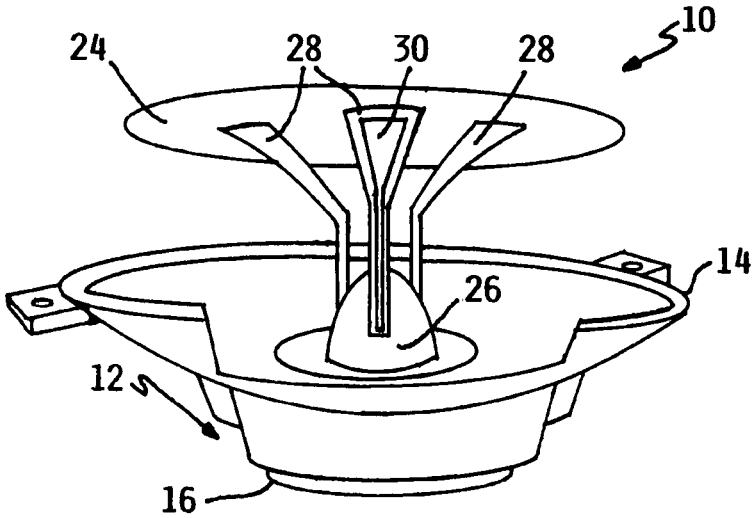
FIG. 4A is a cutaway perspective view of a tactile sound speaker according to another embodiment of the invention.
Figure 4B:
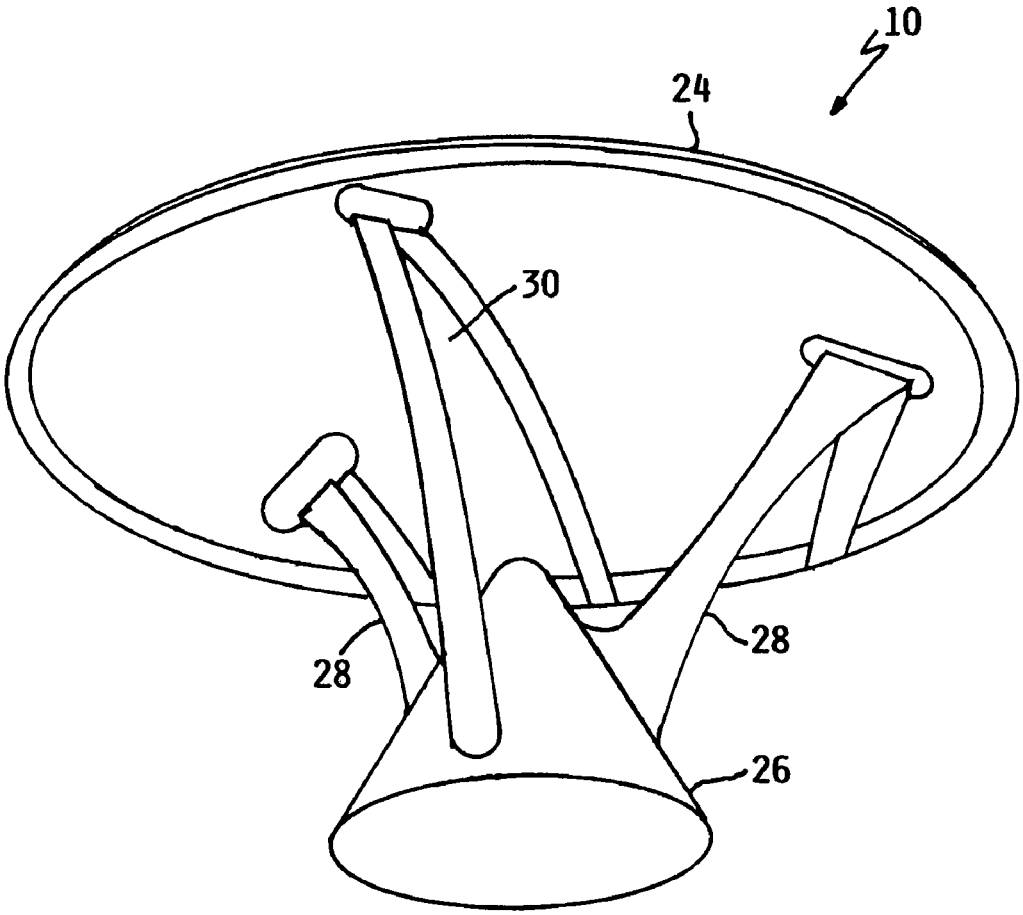
FIG. 4B is a perspective view of the tactile sound speaker of FIG. 4A.
Figure 4C:
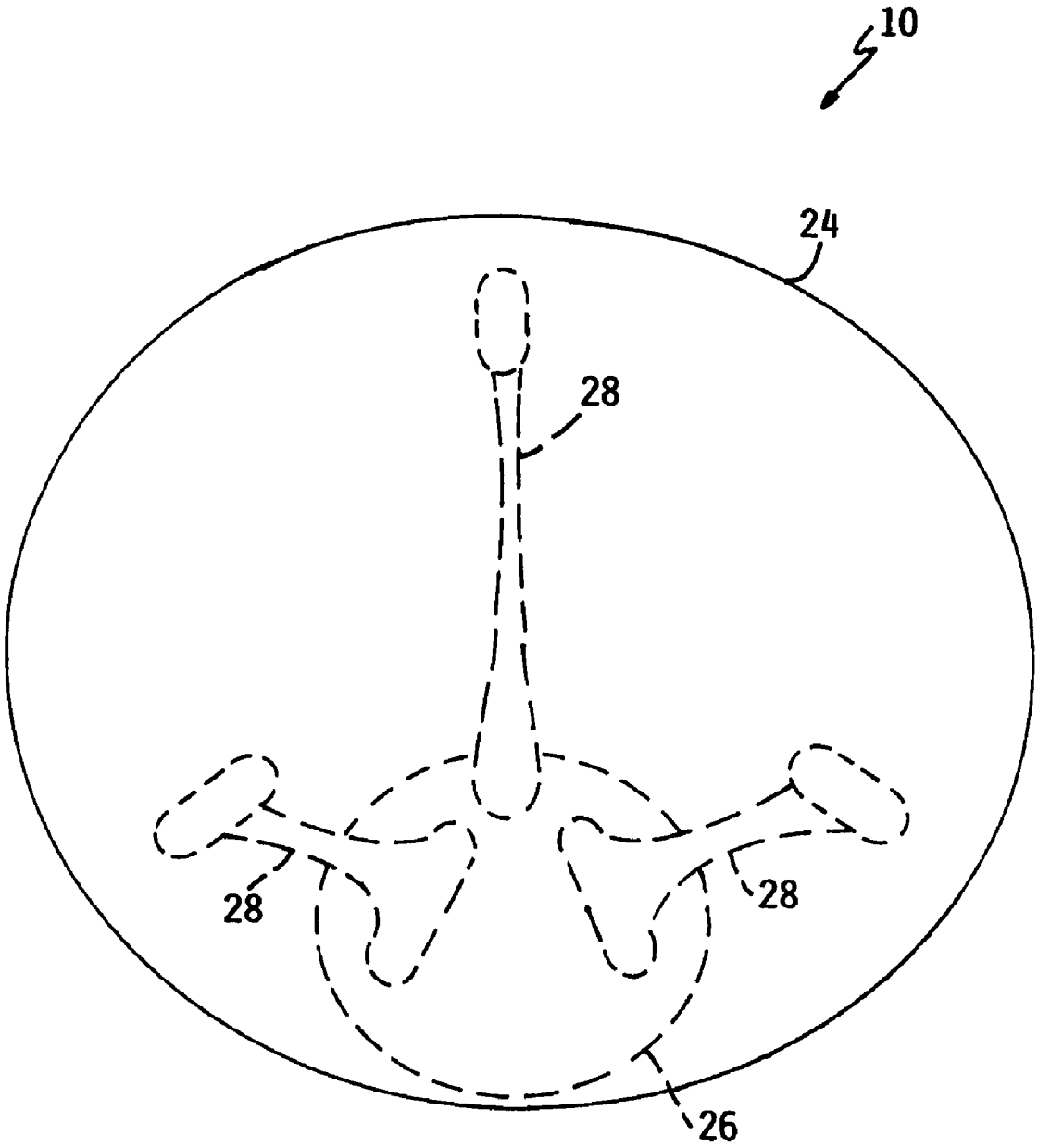
FIG. 4C is a top, perspective view of the tactile sound speaker of FIG. 4A.

FIG. 4A depicts another embodiment of the invention, in which speaker 10 comprises a bullet cone 26 to which a plurality of transmitter shafts 28 are affixed. Similar to FIGS. 1 and 2, speaker 10 comprises three transmitter shafts 28, although of a different configuration than transmitter shafts 18. Transmitter shafts 28 can comprise crystal, glass, plastics, metals, and other materials. In one embodiment, transmitter shafts comprise stainless steel. Transmitter shafts 28 can be solid or hollow and, as depicted, comprise a gap 30 to improve vibration transmission. FIGS. 4B and 4C depict additional views of bullet cone 26, transmitter shafts 28, and touchpad 24 of FIG. 4A.

Figure 5:
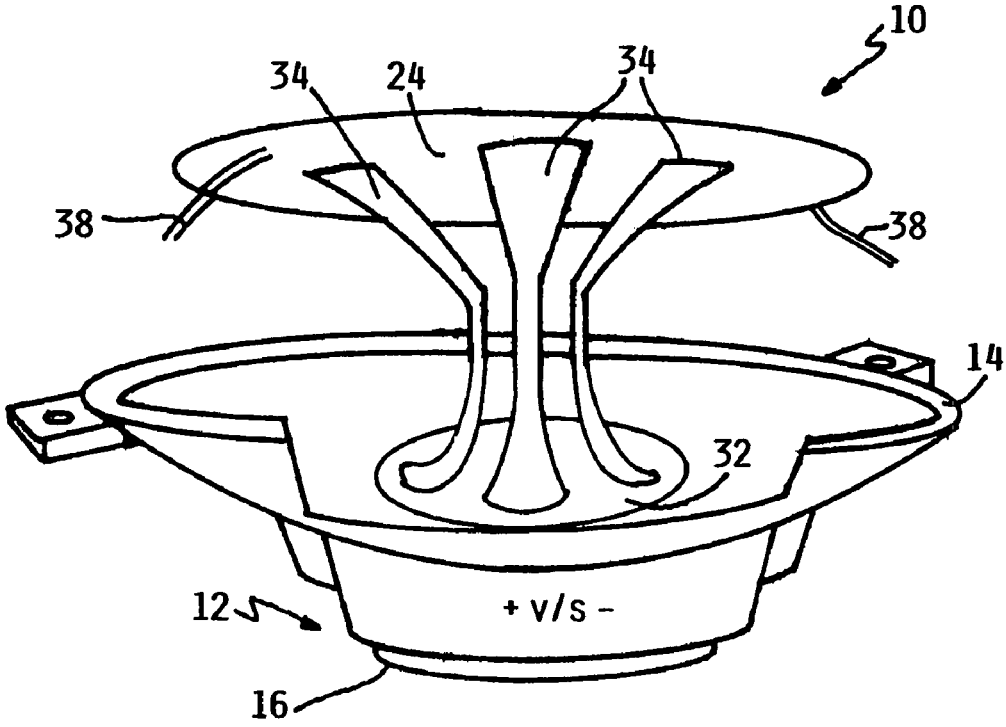
FIG. 5 is a cutaway perspective view of a tactile sound speaker according to another embodiment of the invention.

Referring to FIG. 5, yet another embodiment of speaker 10 is depicted. Speaker 10 comprises a flat cone 32 to which at least one transmitter shaft 34 is attached. Three transmitter shafts 34 are depicted in the embodiment of FIG. 5 and are preferably flat, thin structures comprising metal, acrylic, plastic, stainless steel, titanium, metal, crystal, glass, or some other material having desirable vibration characteristics. Transmitter shafts 34 can be molded directly to or formed contiguously with touchpad 24.

Figure 6A:
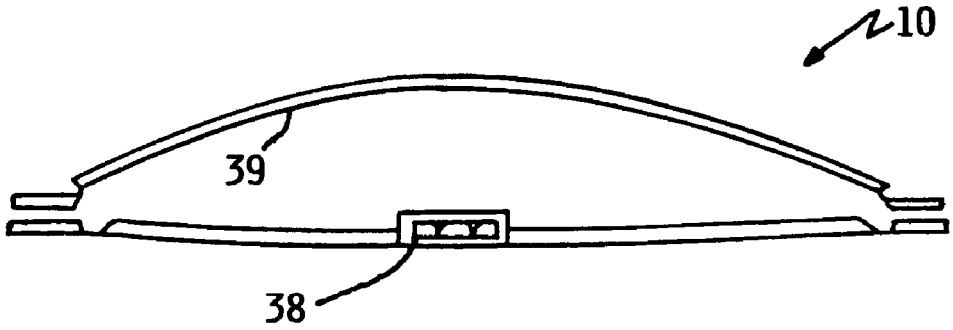
FIG. 6A is a side view of a tactile sound speaker according to another embodiment of the invention.
Figure 6B:
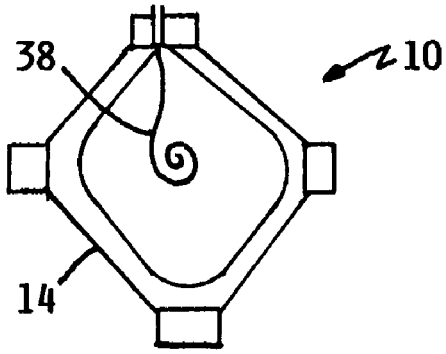
FIG. 6B is a top view of the tactile sound speaker of FIG. 6A.

Touchpad 24 may further comprise a heat element 38, such as a heat ribbon or coil, for regulating the temperature of touchpad 36 and providing a soothing heat effect in use as illustrated in FIGS. 6A and 6B. Heating touchpad 24 provides the additional benefit of avoiding desensitization of nerves in a user's hands or feet due to the vibration provided by speaker 10 via touchpad 24. Heat can also be of benefit to users with poor circulation or other desensitization conditions.

In another embodiment, touchpad 24 further comprises embedded light emitting diodes (LEDs), fiber optics, or another color or light source to illuminate touchpad 24 and provide visual as well as tactile and auditory output during use of speaker 10. Lasers can also be incorporated into speaker 10. LEDs, lasers, fiber optics, and other visual elements of touchpad 24 and speaker 10 allow colors to be displayed, mixed, and, through sound and tactile feedback, felt by a user. Lasers can be beneficial to enhance higher tweeter frequencies. In another embodiment, laser-sensitive particles can be embedded in crystal, glass, plastic, or another material underneath touchpad 24. When excited by a laser or other appropriate light source, the particles add to the visual and overall sensory experience. The color or another display characteristic can vary in one embodiment according to a vibratory or auditory characteristic. In an embodiment including both heat element 38 and a light or color source, the heating of touchpad 24 may provide the additional benefit of giving the color more resonance with the user.

The exterior of touchpad 24 can be coated or treated with a non-reflective coating. Touchpad 24 can optionally include a mirrored surface 39 to reflect and enhance light. Surface 39 can be a neutral color in other embodiments to prevent or restrict reflection.

Figure 7:
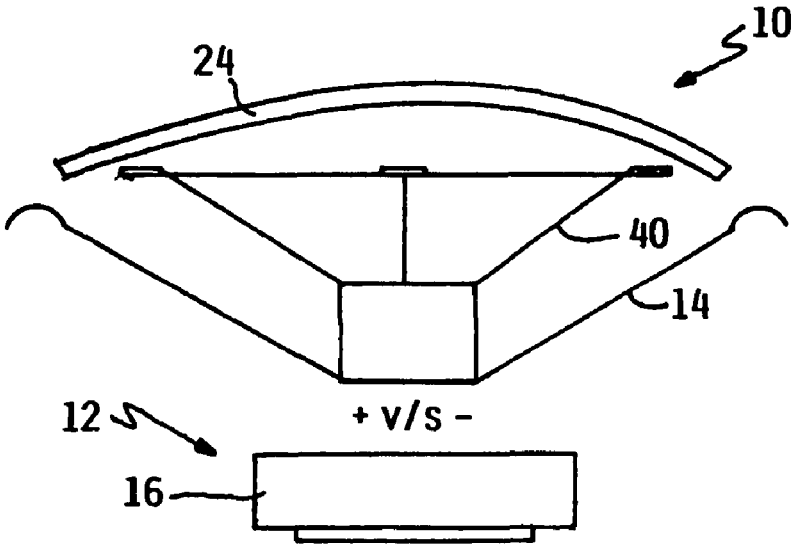
FIG. 7 is a side view of a tactile sound speaker according to another embodiment of the invention.
Figure 8:
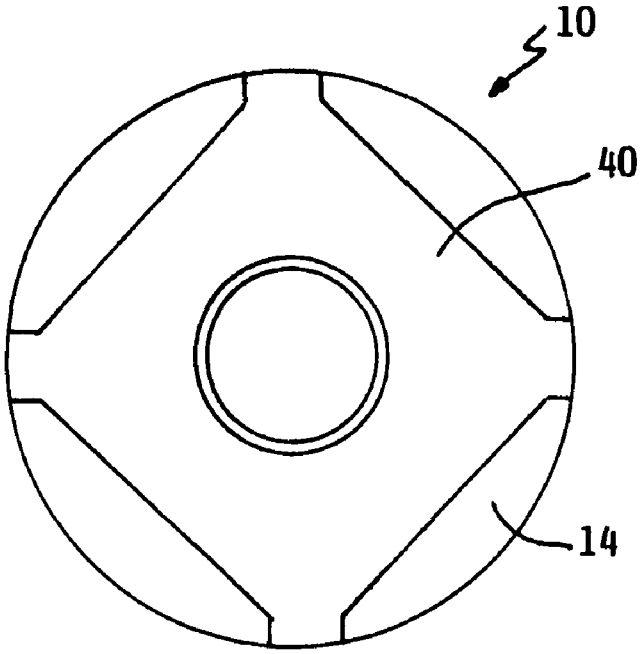
FIG. 8 is a top view of a speaker cone for use with the tactile sound speaker of FIG. 6.
Figure 9A:
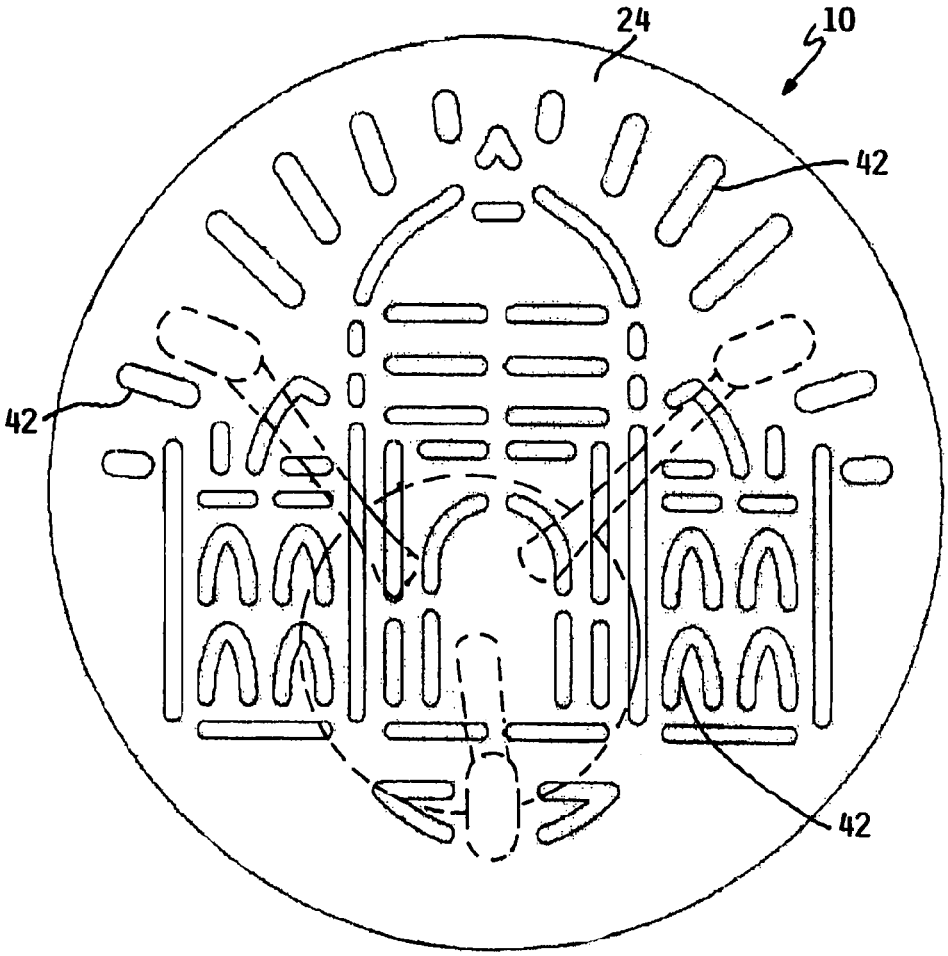
FIG. 9A is a top view of a tactile sound speaker according to one embodiment of invention.
Figure 9B:
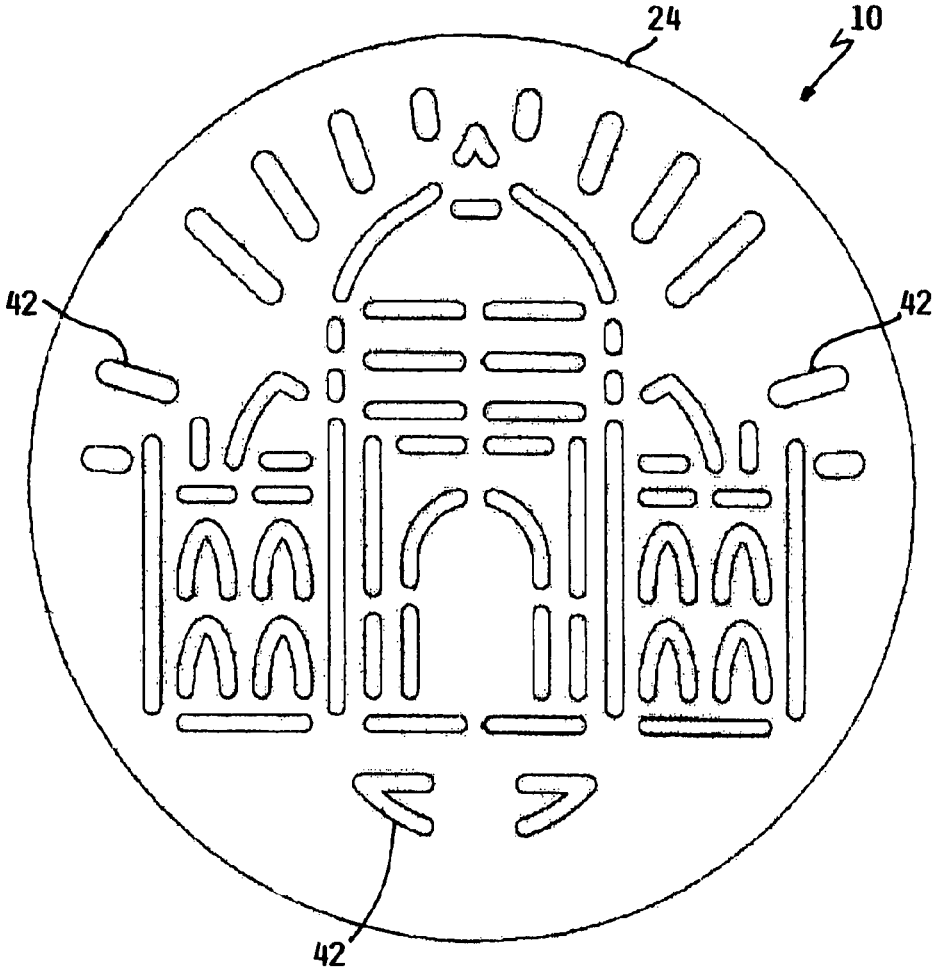
FIG. 9B is a top view of a touchpad according to an embodiment of the invention.
Figure 10A:
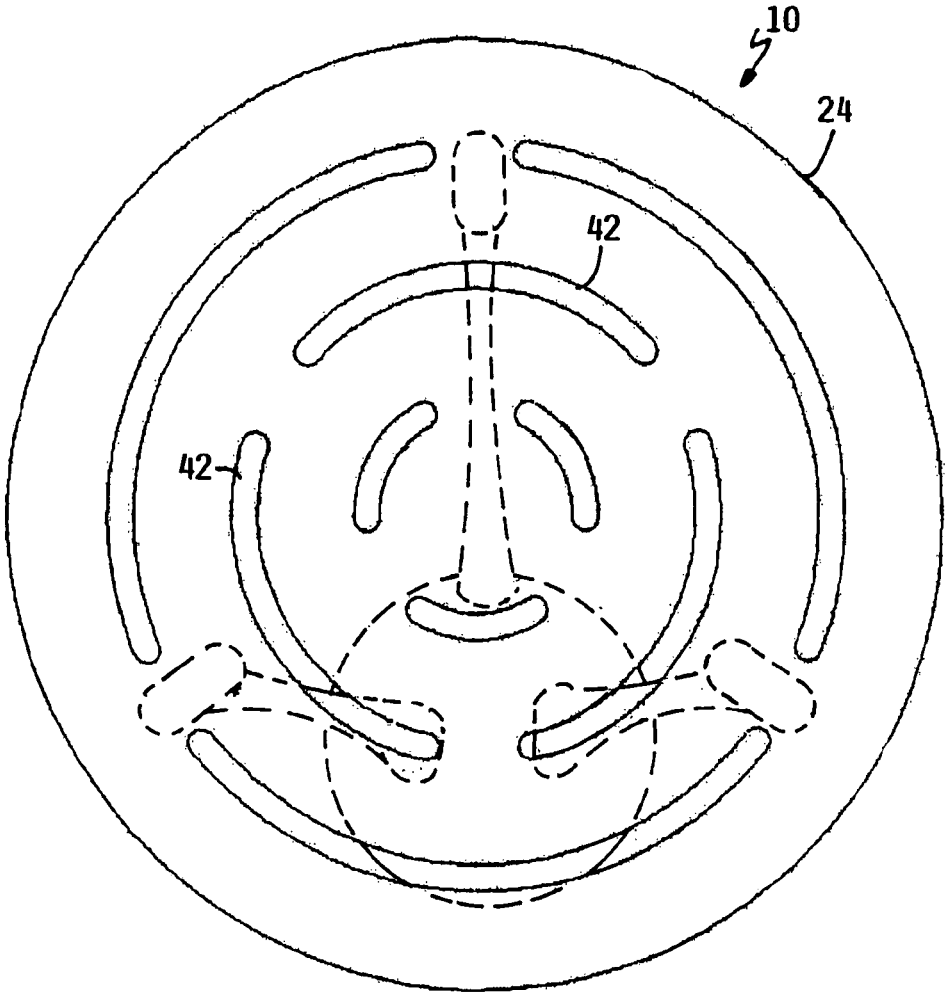
FIG. 10A is a top view of a tactile sound speaker according to one embodiment of the invention.
Figure 10B:
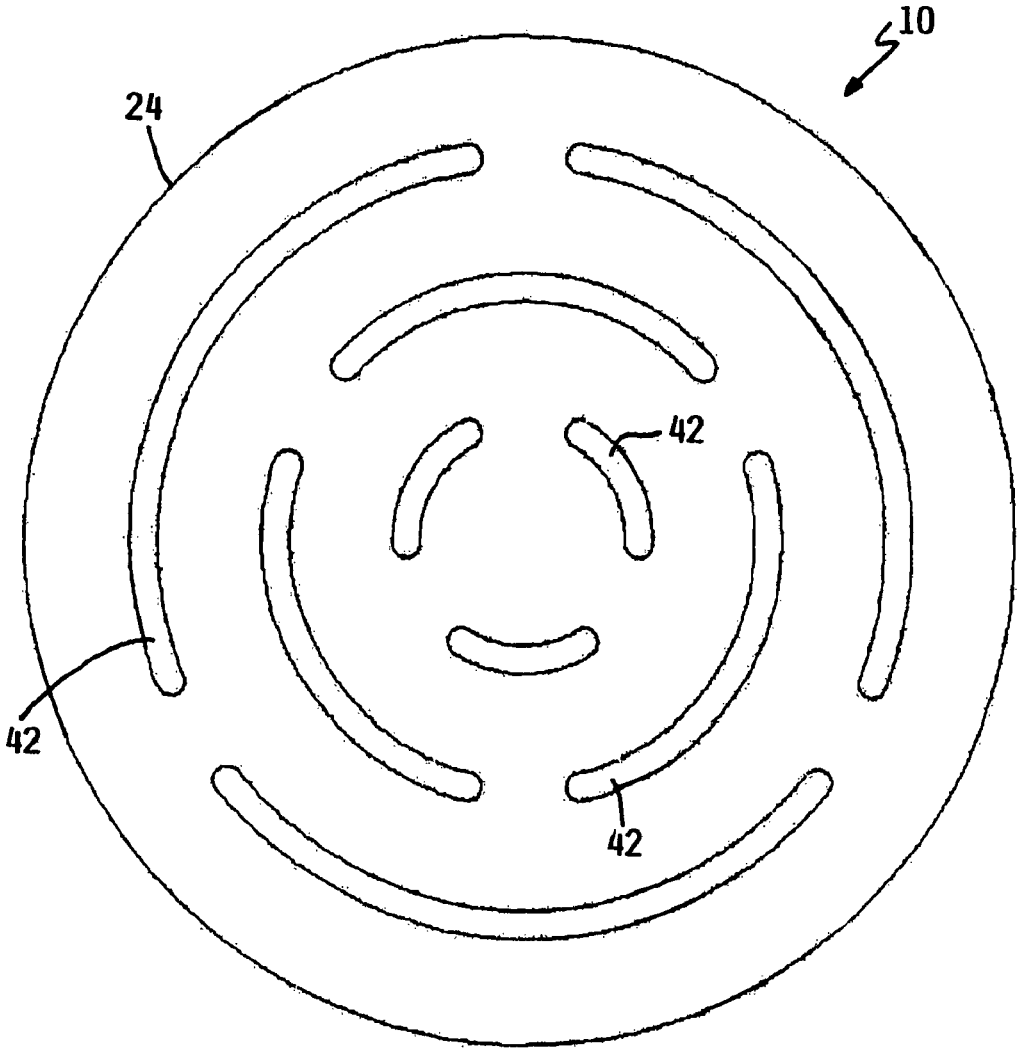
FIG. 10B is a top view of a touchpad according to an embodiment of the invention.
Figure 11A:
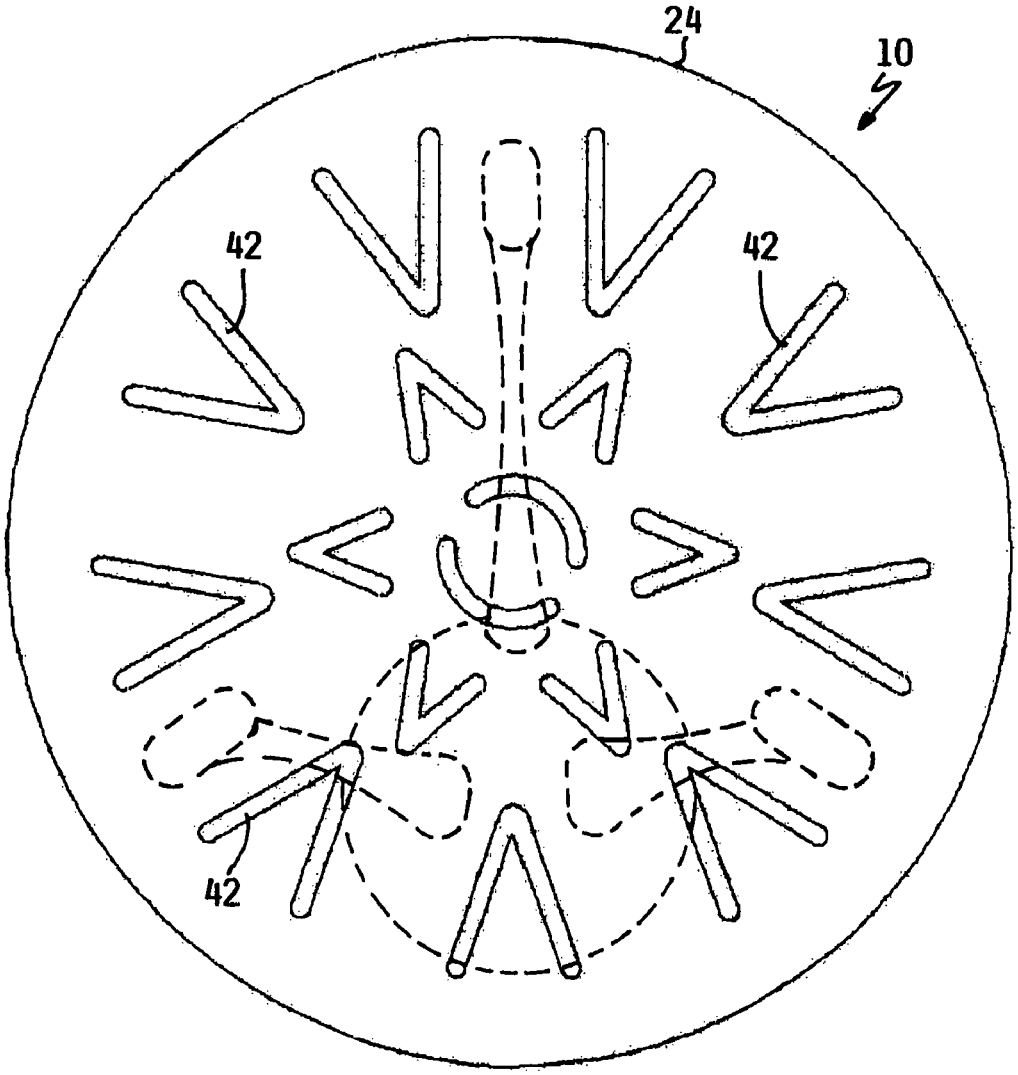
FIG. 11A is a top view of a tactile sound speaker according to an embodiment of the invention.
Figure 11B:
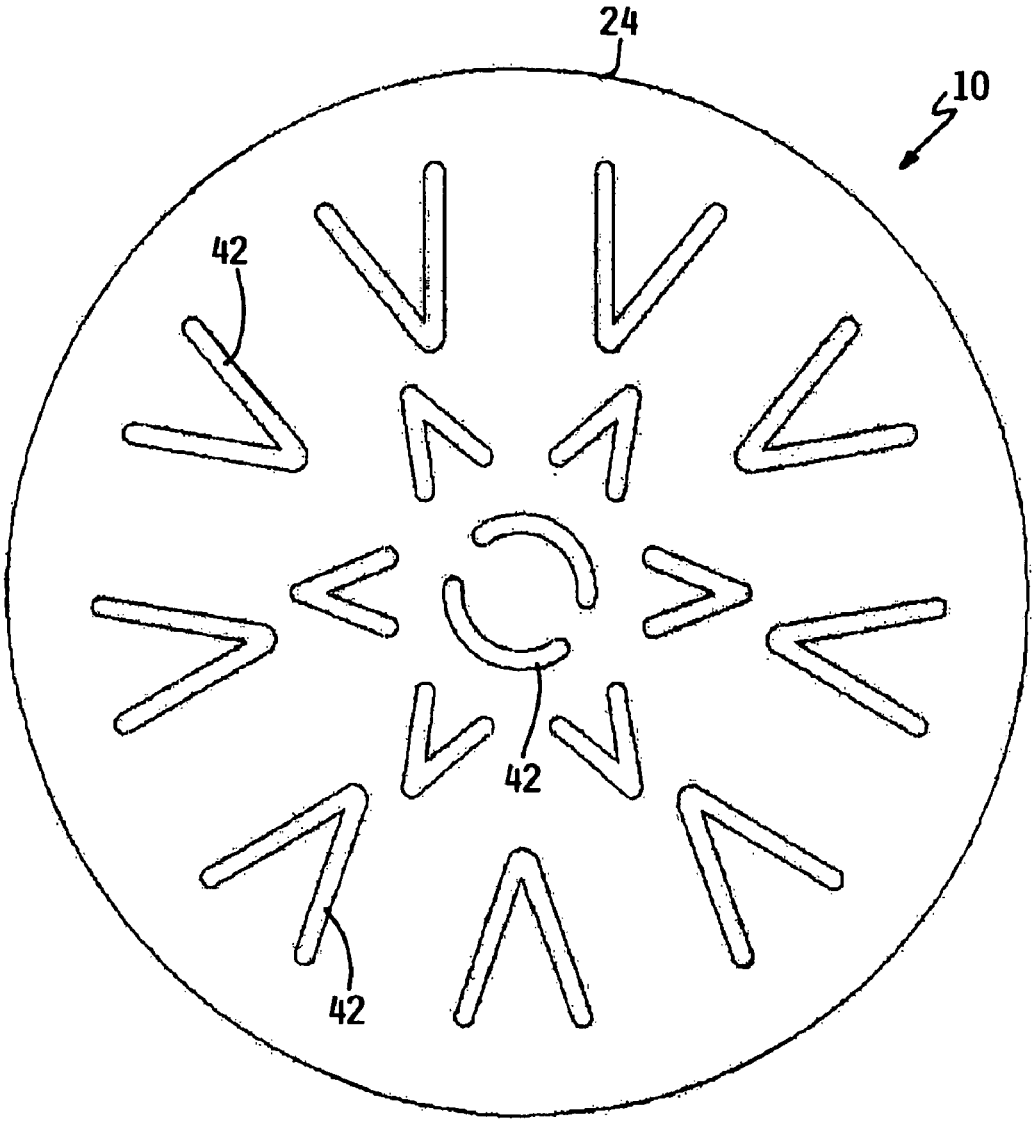
FIG. 11B is a top view of a touchpad according to an embodiment of the invention.

FIGS. 7 and 8 depict another embodiment of speaker 10 comprising a four-point transmission cone 40. Transmission cone 40 can comprise crystal, plastic, glass, metal, or another material, and is attached or coupled to speaker cone 12 at the base of speaker cone 12. In one embodiment, transmission cone 40 is molded with touchpad 24 as a single unit. In another embodiment, touchpad 24 is affixed to transmission cone 40. As illustrated in FIGS. 9A, 9B, 10A, 10B, 11A and 11B, touchpad 24 can be textured so as to include raised or recessed portions 42 to allow a user to better feel midrange frequencies. Touchpad 24 can include raised or recess portions 42 in a variety of alternative configurations depending upon the individual using the speaker 10 or the specified purpose of speaker 10. Transmission cone 40 also facilitates easy mounting of additional touchpad 24 configurations, including square, other geometrics, or freeform designs. In one embodiment, touchpads 24 can be custom created by molding a particular user's hand or foot for a personalized fit.

Figure 12:
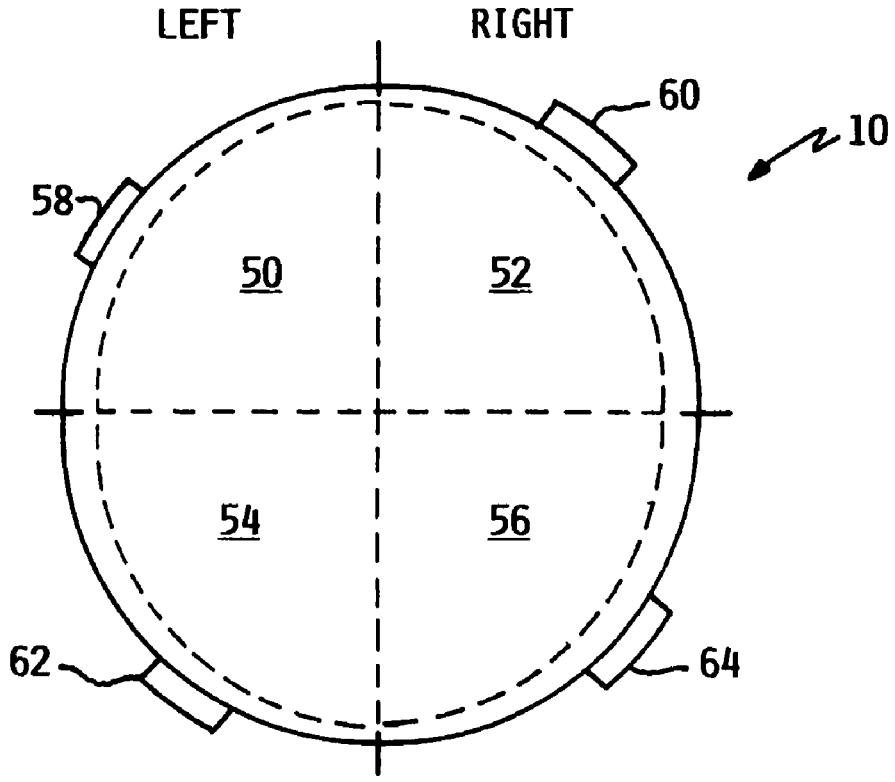
FIG. 12 is a top view of a tactile sound speaker according to another embodiment of the invention.

FIG. 12 depicts yet another embodiment of speaker 10, in which touchpad 24 comprises a plurality of tactile or sensory zones 50, 52, 54, and 56. Zones 50-56 can provide a directed right-left brain input sequence according to hand or foot placement or input. For example, intentional input, such as specific frequencies, can be focused and then sent through a user's hands or feet to quadrants of the brain that handle speech, sight, hearing, smell, and touch. A plurality of input ports 58, 60, 62, and 64 for customized and varied sensory inputs such as heat, light, or additional vibration can further enhance a user's sensory experience. Ports 58-64 can comprise metals, plastics, minerals, or other organic or inorganic materials to control absorbent referencing of a frequency to match a particular material. For example, in a natural sequence, a low frequency will attach to a dense material and a high frequency to a highly responsive material.

Figure 13A:
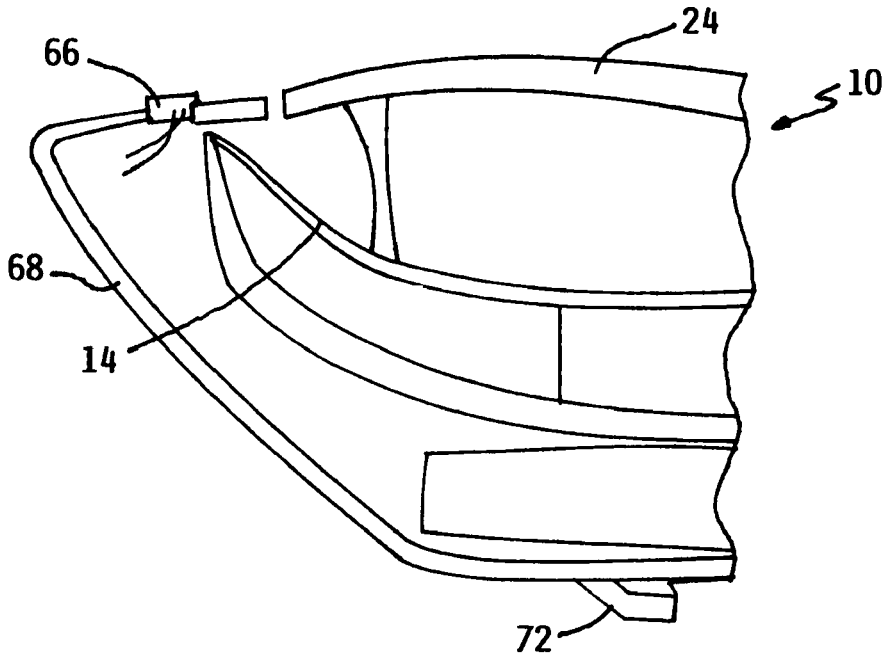
FIG. 13A is a cutaway side view of a tactile sound speaker according to another embodiment of the invention.
Figure 13B:
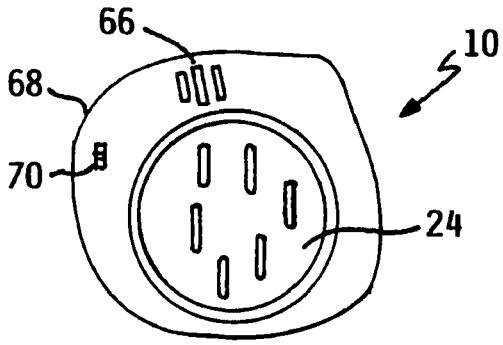
FIG. 13B is a top view of the tactile sound speaker of FIG. 13A.

Referring to FIGS. 13A and 13B, one embodiment of the invention further comprises a volume control 66 and a temperature control 70 on an external housing 68 of speaker 10. Volume control 66, in one embodiment, comprises individual adjustment controllers for treble, bass, and general volume. Volume control 66 and temperature control 70 are conveniently located on external housing 68 to enable a user to quickly make adjustments in use. External housing 68 can further comprise an attachment lock 72 to secure external housing 68 and speaker 10 to a tripod or other speaker mount.

Figure 14:
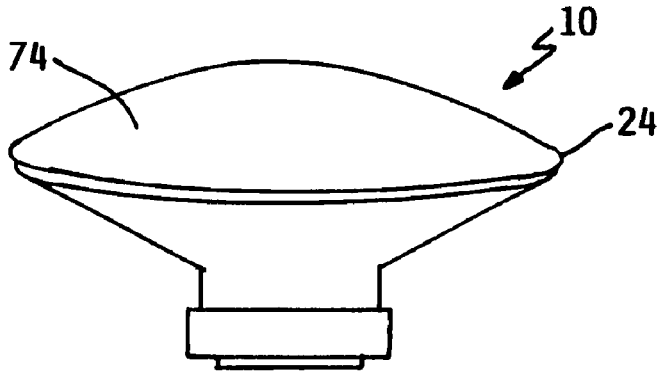
FIG. 14 is a side view of a tactile sound speaker and prophylactic according to one embodiment of the invention.
Figure 15A:
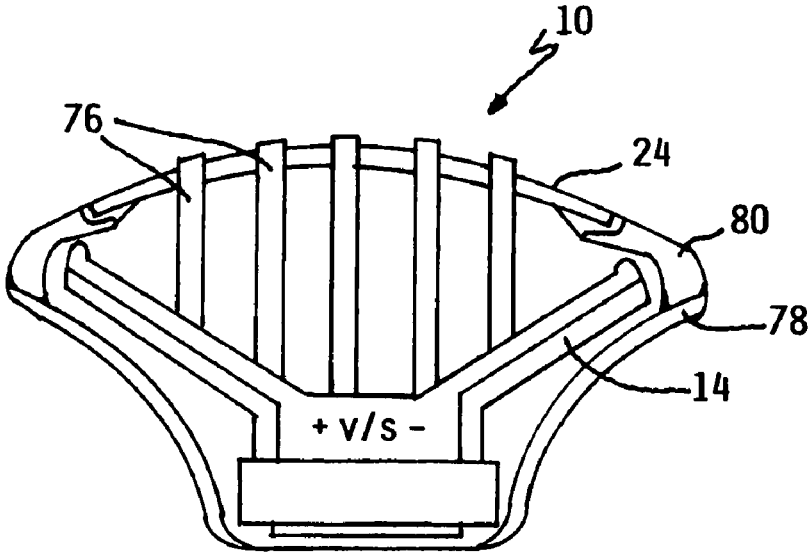
FIG. 15A is a side cutaway view of a tactile sound speaker according to another embodiment of the invention.
Figure 15B:
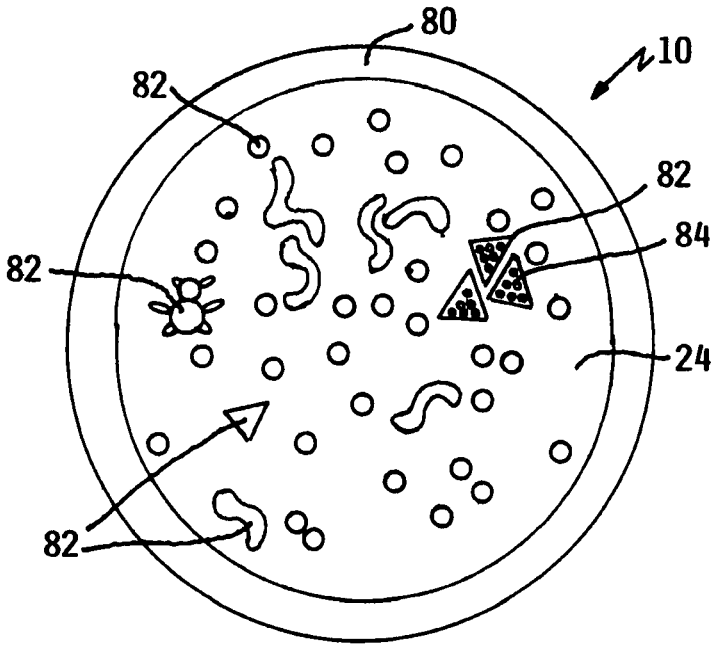
FIG. 15B is a top view of the tactile sound speaker of FIG. 15A.
Figure 15C:
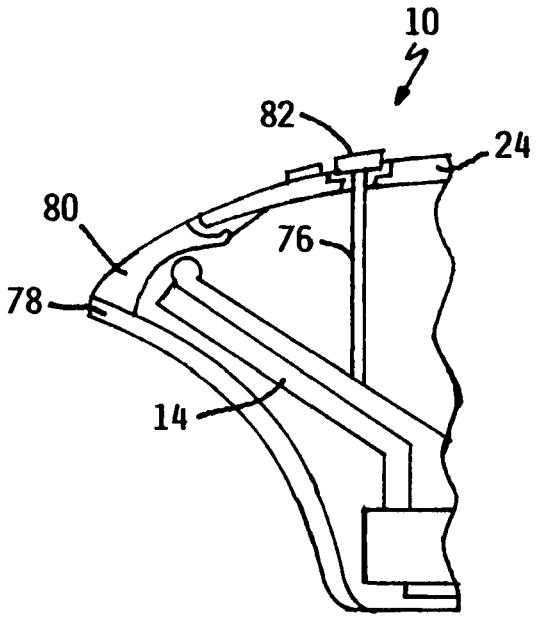
FIG. 15C is a detail side cutaway view of the tactile sound speaker of FIG. 15A.
Figure 15D:
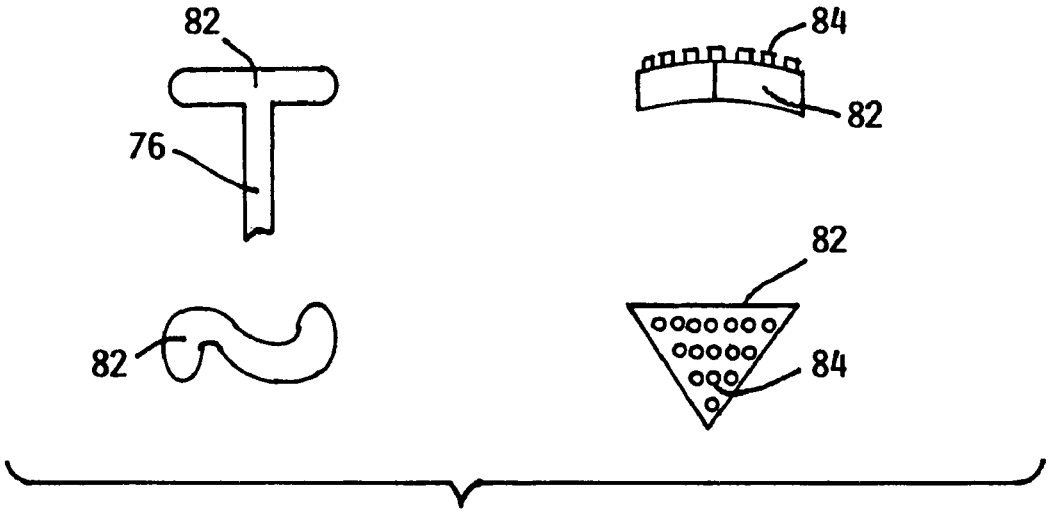
FIG. 15D is a set of detail views of a tactile vibration transmitter shaft of FIGS. 15A-C.

As mentioned above, removable and replaceable, or washable, covers may be fitted over touchpad 24 for use in clinical or therapeutic environments in which many users utilize a single speaker 10. Referring to FIG. 14, touchpad 24 of speaker 10 is fitted with a prophylactic 74. Prophylactic 74 can be single-use and disposable in one embodiment and can comprise rubber, plastic, or some other suitable material having sufficient elasticity to cover and generally conform to touchpad 24 while also being thin enough to not reduce sensitivity or impede vibration transmission to a user. In other embodiments, prophylactic 74 can be washable or cleanable. Prophylactic 74 can also be textured or patterned to improve the tactile experience and/or visual appeal.

In one embodiment, prophylactic 74 can be treated with an anti-bacterial or other medicinal product to prevent the spread of germs or disease among multiple users of a single speaker 10. Prophylactic 74 can also be treated with a product to provide a cooling or warming sensation or pleasant scent during use to improve sensitivity and therapeutic effect.

Referring to FIGS. 15A, 15B, 15C and 15D, speaker 10 can also comprise one or more tactile vibration transmitter shafts 76 that extend from an interior surface of speaker cone 14 to or beyond the upper surface of touchpad 24. Touchpad 24 can be movably coupled to an exterior housing 78 by a rubber gasket 80.

Tactile vibration transmitter shafts 76 can be arranged in any pattern within speaker cone 14 and can comprise virtually any shape or material, for example as described above with reference to FIGS. 1-13B. In one embodiment, one or more of shafts 76 comprise a tactile surface sensor pad 82. Sensor pads 82 can be arranged to be flush, or slightly raised or recessed, with touchpad 24 and can be designed and placed on or within touchpad 24 to activate hand or foot acupressure points to further stimulate, massage, and therapeutically treat a user.

Sensor pads 82 can comprise virtually any shape or configuration to improve tactile experience and/or visual appeal. A variety of shapes of sensor pads 82 on a single speaker 10 will increase the variety of tactile experiences provided by providing different surfaces and edges that stimulate nerve receptors for deeper feeling. Sensor pads 82 can be shaped and colored, for example, to appeal to children, such as animal characters, or can comprise corporate or other logos. In one embodiment, sensor pads 82 can also comprise an upper texture surface 84 to better stimulate nerve receptors in the skin of a user to improve and enhance the user's tactile experience. Texture surface 84 can be of the same or a different material as, or can be coated or applied to, transmitter shafts 76.

FIGS. 16A, 16B, 16C, 16D and 16E depict additional embodiments of the invention, wherein speaker 10 comprises a full enclosure gasket vibration tactile system. A gasket 86 comprising rubber, plastic, or another suitable semi-flexible material, couples touchpad 24 to exterior housing 78. Gasket 86 can flex to accommodate mechanical movement and various sound frequencies emitted by speaker driver 12 and further accommodates user compression of touchpad 24 by a hand or foot. Gasket 86 can be glued, sealed, or otherwise coupled to touchpad 24, and can similarly be glued, hot molded, or otherwise coupled to exterior housing 78. In one embodiment, gasket 86 is at least partially coupled to exterior housing 78 by one or more internal studs 87 for improved strength. In this and other embodiments, such as described above, touchpad 24 can comprise virtually any desired shape and configuration and can have consistent or inconsistent apertures and textured areas for increased sensitivity and a heightened tactile experience.

Figure 16A:
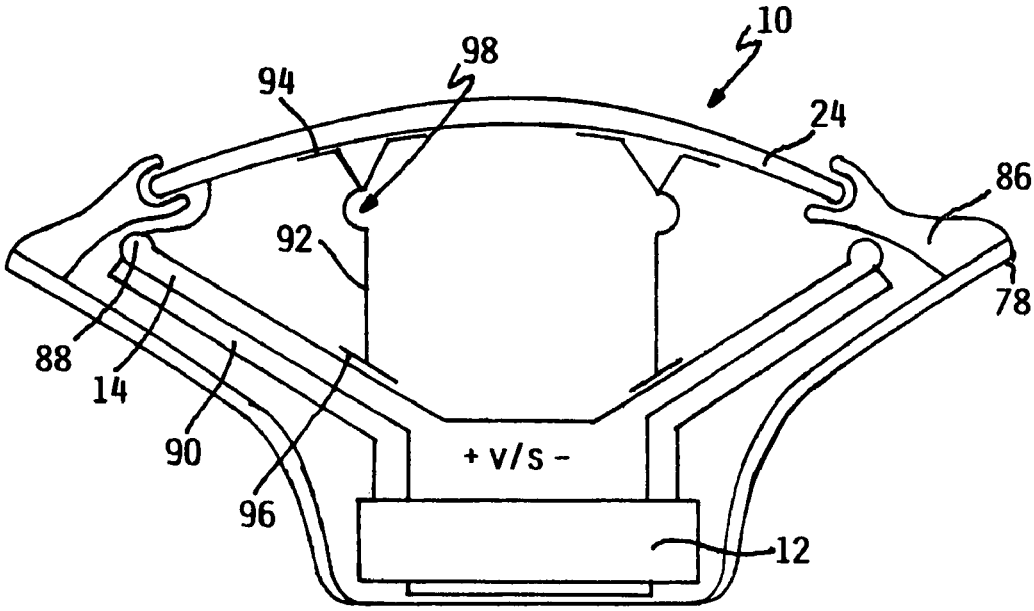
FIG. 16A is a side cutaway view of another embodiment of a tactile sound speaker according to the invention.
Figure 16B:
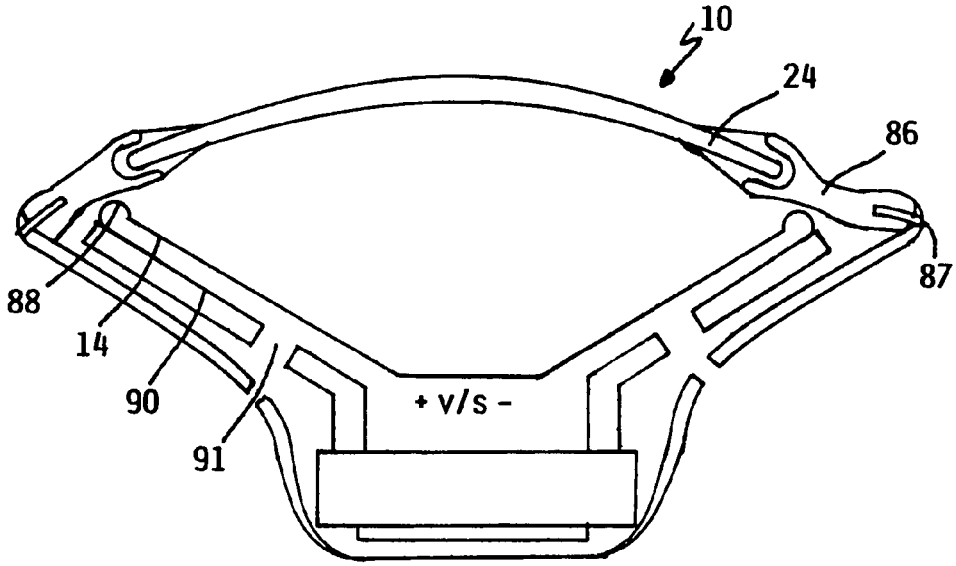
FIG. 16B is a side cutaway view of another embodiment of the tactile sound speaker of FIG. 16A.
Figure 16C:
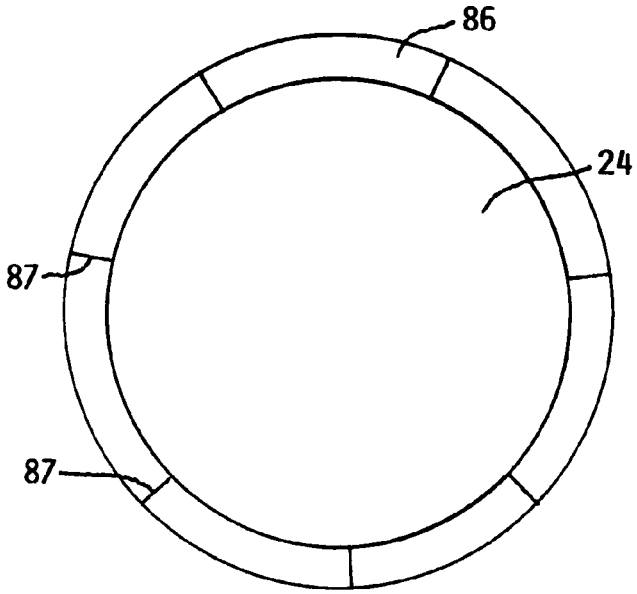
FIG. 16C is a top view of the tactile sound speaker of FIG. 16B.

In the embodiment of FIG. 16A, speaker cone 14 further comprises attachment 88 to a speaker housing 90. Attachment 88 provides enhanced vibration in touchpad 24 to accent music or other sound to the nervous system and to also dampen vibration transmitted to exterior housing 78. Attachment 88 may comprise rubber, plastic, or another suitable semi-flexible material. Referring in particular to the embodiment of FIG. 16B, exterior housing 78 and speaker housing 90 can comprise a vent 91 for air compression.

As shown in FIG. 16A, speaker 10 can also comprise one or more vibration transmission spring recoil connector 92. Movement can expand and contract spring recoil connector 92 from speaker cone 14 to touchpad 24 and adjust back to an origin. Spring recoil connectors 92 can be designed for maximum efficiency of activated movement and can comprise a touchpad tactile attachment 94, a speaker cone tactile attachment 96, and at least one spring recoil compression point 98. Spring recoil connector 92 can comprise metal, metal alloy, glass, plastic, or some other suitable material or combination thereof and can be of a uniform or varied thickness to provide varying levels of recoil and flexibility of speaker cone 14 movement. In one embodiment, spring recoil compression point 98 comprises a first material and the remainder of spring recoil connector 92 comprises a second material. In an embodiment of speaker 10 comprising a plurality of spring recoil connectors 92, one or more connectors 92 can comprise a first material while one or more other spring recoil connectors 92 comprise a second or other materials to provide varied compression and vibration of touchpad 24.

Figure 16D:
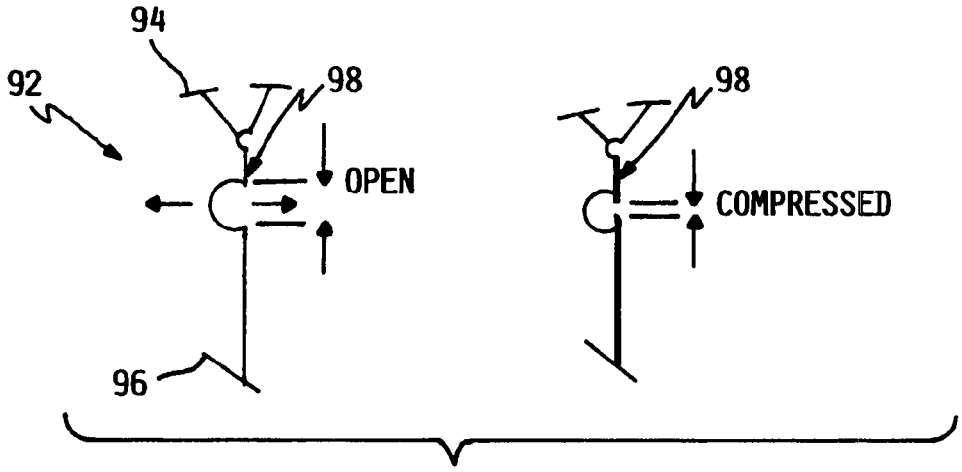
FIG. 16D is a set of side views of embodiments of a vibration transmission spring recoil connector of FIG. 16A.
Figure 16E:
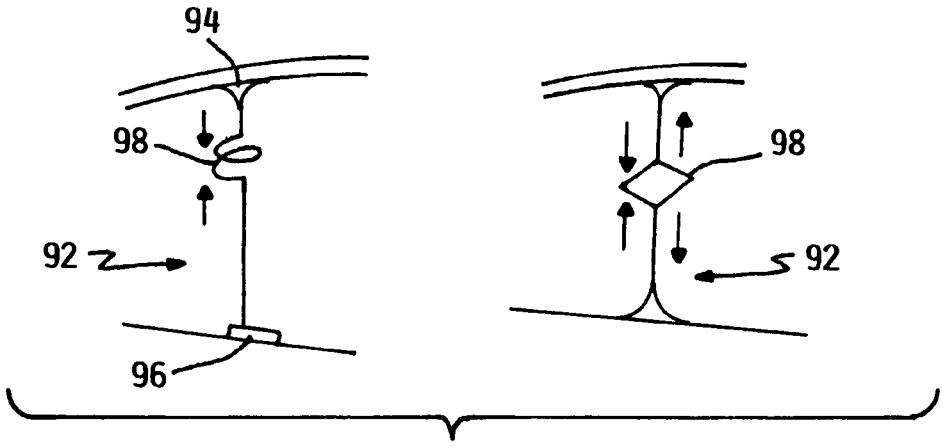
FIG. 16E is a set of side views of embodiments of a vibration transmission spring recoil connector of FIG. 16A.

As depicted in FIGS. 16D and 16E, spring recoil compression point 98 can comprise one of many possible configurations. The particular shape and configuration of each touchpad tactile attachment 94 and speaker cone tactile attachment 96 can also vary in embodiments of the invention.

In use, music, vocals, or another source of sound are produced on speaker 10 while a user contacts touchpad 24 with a hand, foot, or other body part. In another embodiment, the actual auditory output is muted, providing only or substantially only vibratory output. Speaker 10 can be a standalone unit or may be part of a larger sound, computer, or entertainment system. Temperature, light, and color outputs may be provided by speaker 10 and touchpad 24 or by other parts of the system for additional therapeutic or entertainment benefit.

Figure 17A:
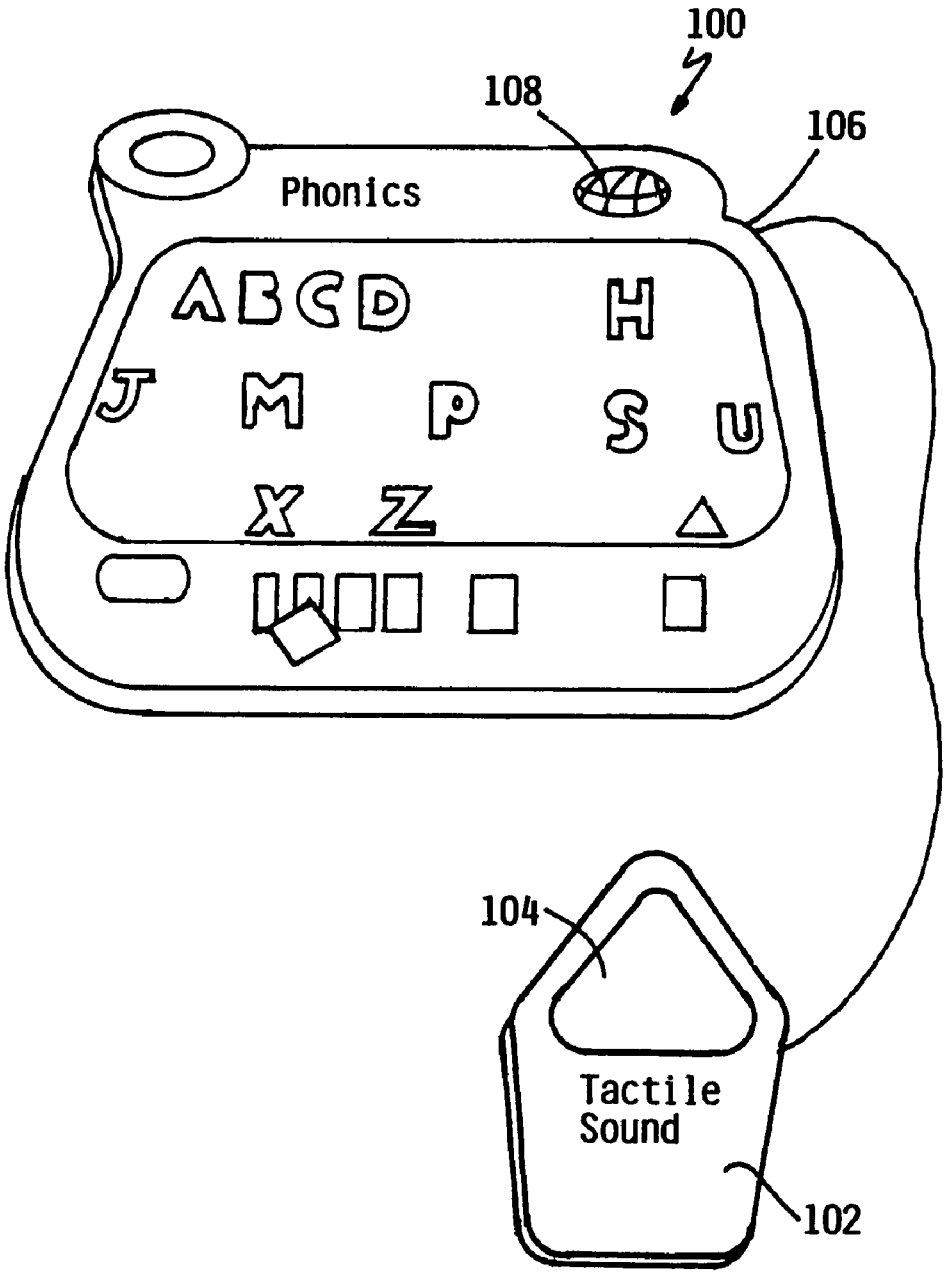
FIG. 17A is a perspective view of a tactile sound phonics device according to one embodiment of the invention.
Figure 17B:
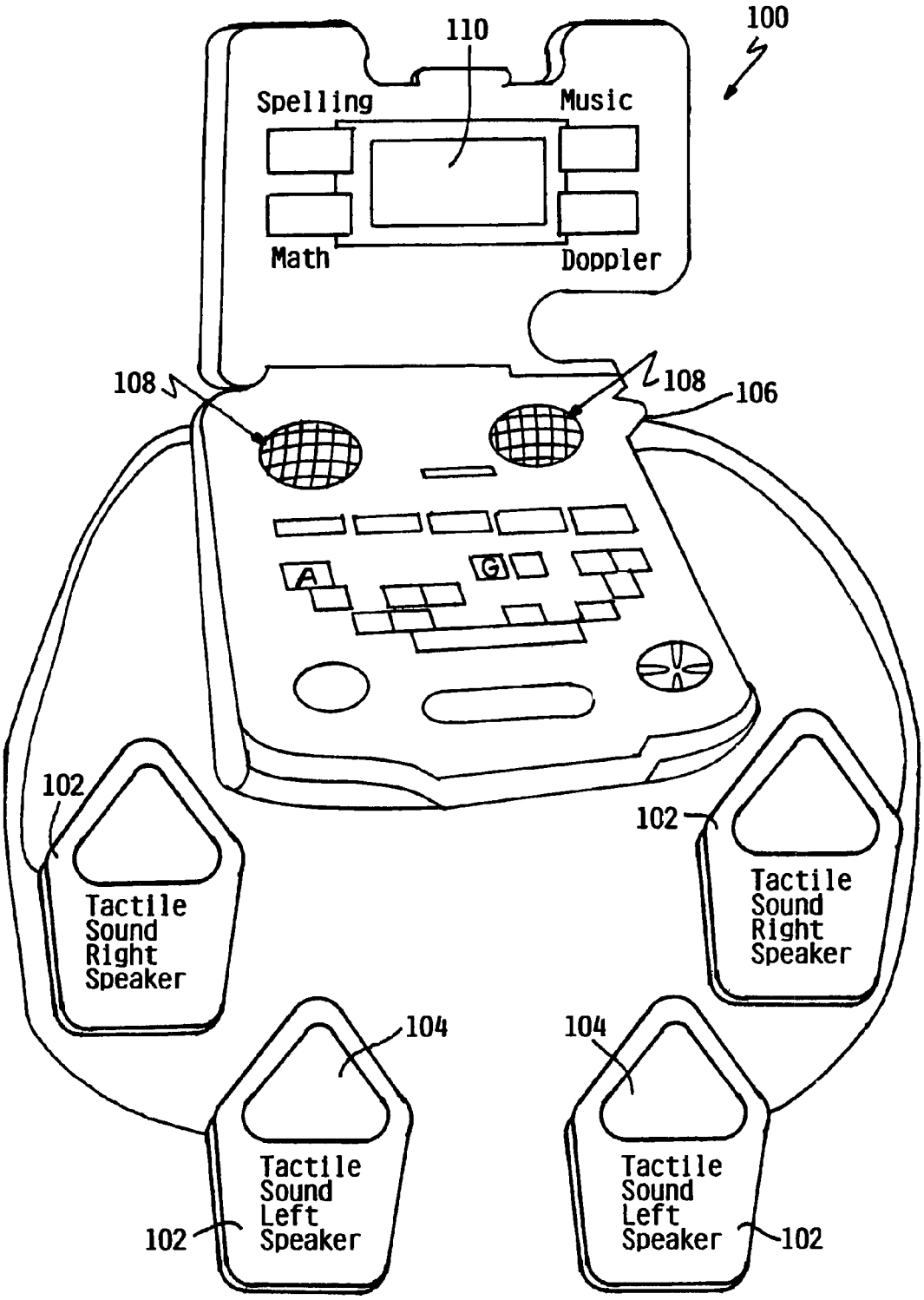
FIG. 17B is a perspective view of a tactile sound phonics device according to another embodiment of the invention.

In other embodiments, at least a portion of speaker 10 and touchpad 24 is embedded, for example, in a seat, cushion, chair, bed, game, toy, plush, or another object or piece of furniture, or is adapted to electrically or mechanically couple with an existing speaker or music player. For example, in one embodiment an auxiliary auditory output adapter couples a simplified touchpad 24 with a computer or portable music player. Children's computer games and toys in particular often have multiple use programs, such as math, spelling, music, phonics, drawings, and the like. Referring to FIGS. 17A and 17B, a tactile sound phonics device 100 would enable children and other users to feel sounds associated with activities offered by device 100 through a tactile speaker peripheral device 102 communicatively coupled to device 100 by a peripheral outlet 106. Device 100 can comprise a plurality of outlets 106 to enable multiple users to share device 100, each having the own tactile speaker peripheral device 102. In use, a phonics application would enable a user to feel sounds values of syllables and words through a touchpad 104 of device 102 and teach object recognition by both sound and sight. Device 100 can also comprise an external mono speaker 108.

In the embodiment of FIG. 17B, device 100 comprises right and left stereo tactile speaker peripheral devices 102 having touchpads 104, external right and left stereo speakers 108, and a screen 110. Device 100 of Figure can be used simultaneously by two users and provides an enhanced stereo experience.

In use, a user places one hand on tactile speaker peripheral device 102 and uses the other hand to operate device 100. Left-right eye and brain function and coordination are therefore enabled. In one embodiment, tactile speaker peripheral device 102 can be integrated or combined with other features of device 100, such as a mouse or controller. In other embodiments, device 100 and/or device 102 are related to or partially or completely integrated with another device, such as a personal desktop or laptop computer.

Device 100 can help to improve left and right brain processing, particularly in the embodiment of FIG. 17B in which stereo tactile speaker peripheral devices 102 are used. Auditory examples in which dynamic tactile sound may be experienced include music crescendo, Doppler effect, and spatial, movement, and distance effects. In everyday conversation, volume, inflection, and other spoken voice characteristics provide a shared emotional and contextual experience for listeners. By enhancing a listening experience provided by device 100, and other tactile sound environments provided by the present invention, a greater understanding of emotions may be gained, especially at early stages of brain development. Sounds that are happy or joyous, as well as those that are sad or angry, can be felt as well as heard. Similarly, the sounds of a barking or growling dog and a purring cat would convey different emotions and create different environments. Embodiments of tactile sound device 100, as well as of speaker 10 described above, may therefore create and explain dynamic interpersonal, interactive, and emotive life experiences and positions and provide therapeutic effects, and social learning and growth, in use.

With respect to therapeutic effects, embodiments of device 100 and speaker 10 may be beneficial, for example, in speech, language, and other therapies. Embodiments of speaker 10 and device 100 that incorporate temperature therapies, heat or cooling, can also provide therapeutic nervous system effects and may promote healing of body tissues. Refer, for example, to the Atlas of Anatomy, published by T&J BOOKS, which is incorporated herein by reference.

Figure 18:
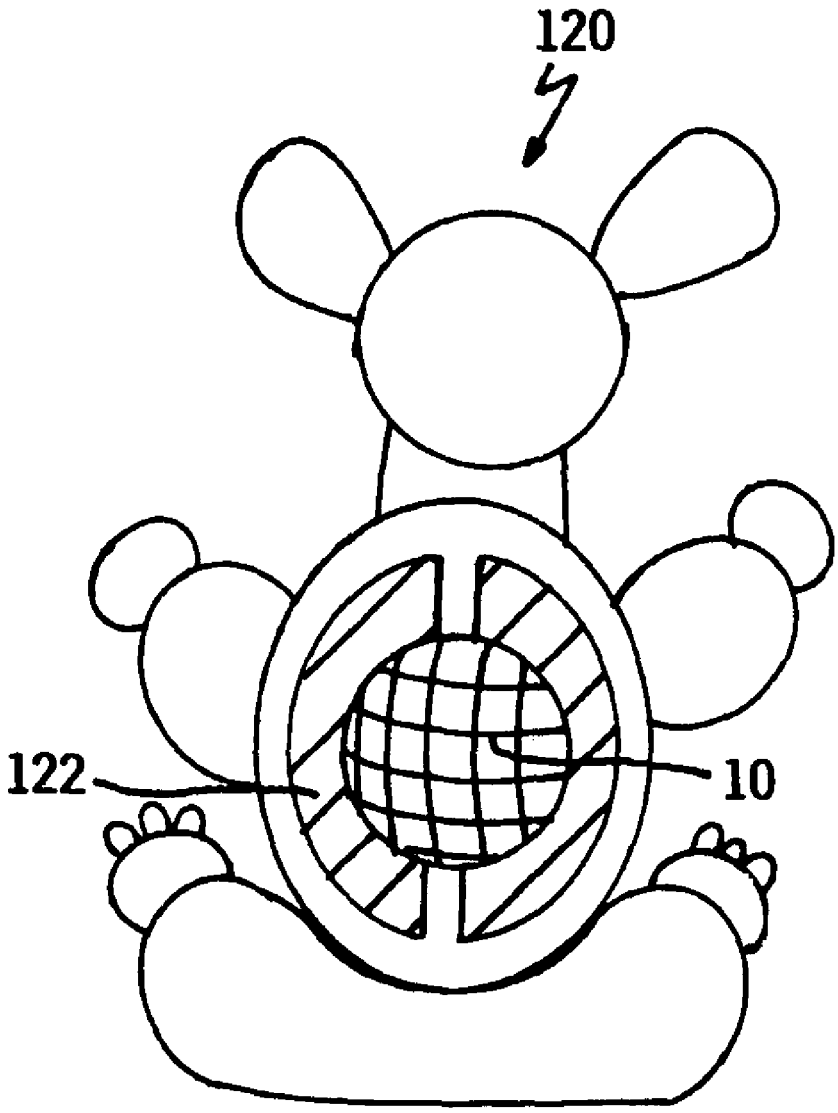
FIG. 18 is a cutaway side view of a toy including an embedded tactile sound speaker according to one embodiment of the invention.

As previously mentioned, at least a portion of speaker 10 and touchpad 24 is embedded, for example, in a seat, cushion, chair, bed, game, toy, plush, or another object or piece of furniture. In the embodiment of FIG. 18, an embodiment of speaker 10 is embedded in a children's toy 120. Speaker 10 is at least partially surrounded by a tactile implant material 122 in one embodiment to carry the primary vibration from speaker 10 to the material of toy 120. Tactile implant material 122 can comprise a material that heightens or sensitizes the vibration produced by speaker 10 while still utilizing the plush and comfortable to hold material of toy 120. In another embodiment, material 122 is included on an exterior portion of toy 122 to further enhance a tactile sound experience.

In the embodiment of FIG. 18, speaker 10 can be powered by, for example, replaceable or rechargeable batteries or another suitable and safe power source. The sound source associated with speaker 10 can be embedded in speaker 10, coupled to speaker 10 internal to toy 120, or external to toy 120 but communicatively coupled to speaker 10. Toy 120 can also comprise an external volume or other sound control. Speaker 10 and/or toy 120 can further comprise programmed and/or programmable microchips to provide sound and initiate vibration of speaker 10 and tactile material 122. Although a plush toy 120 is depicted in FIG. 18, other types of toys and objects, both plush and non-plush, can be used in other embodiments of the invention.

Figure 19:
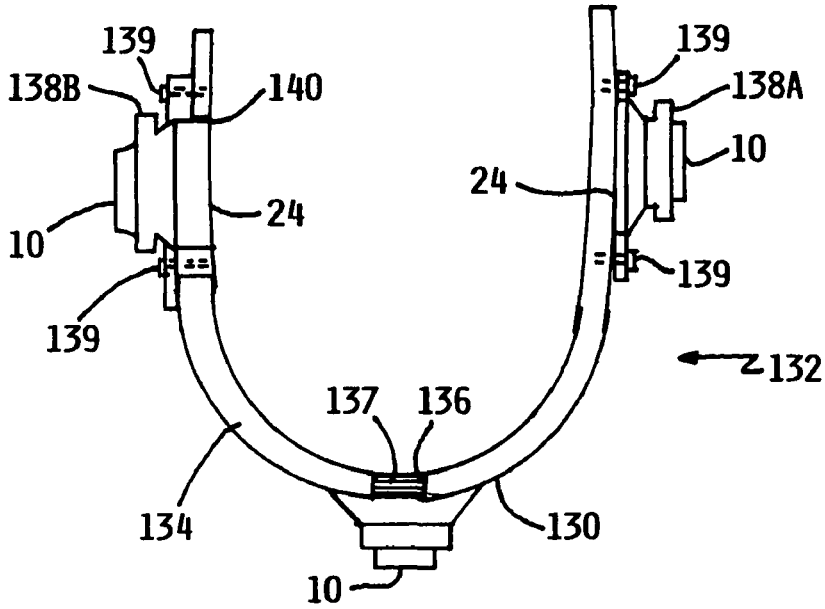
FIG. 19 is a section view of an embodiment of a tactile prosthesis displaying a variety of mounting configurations for a tactile speaker.
Figure 19A:
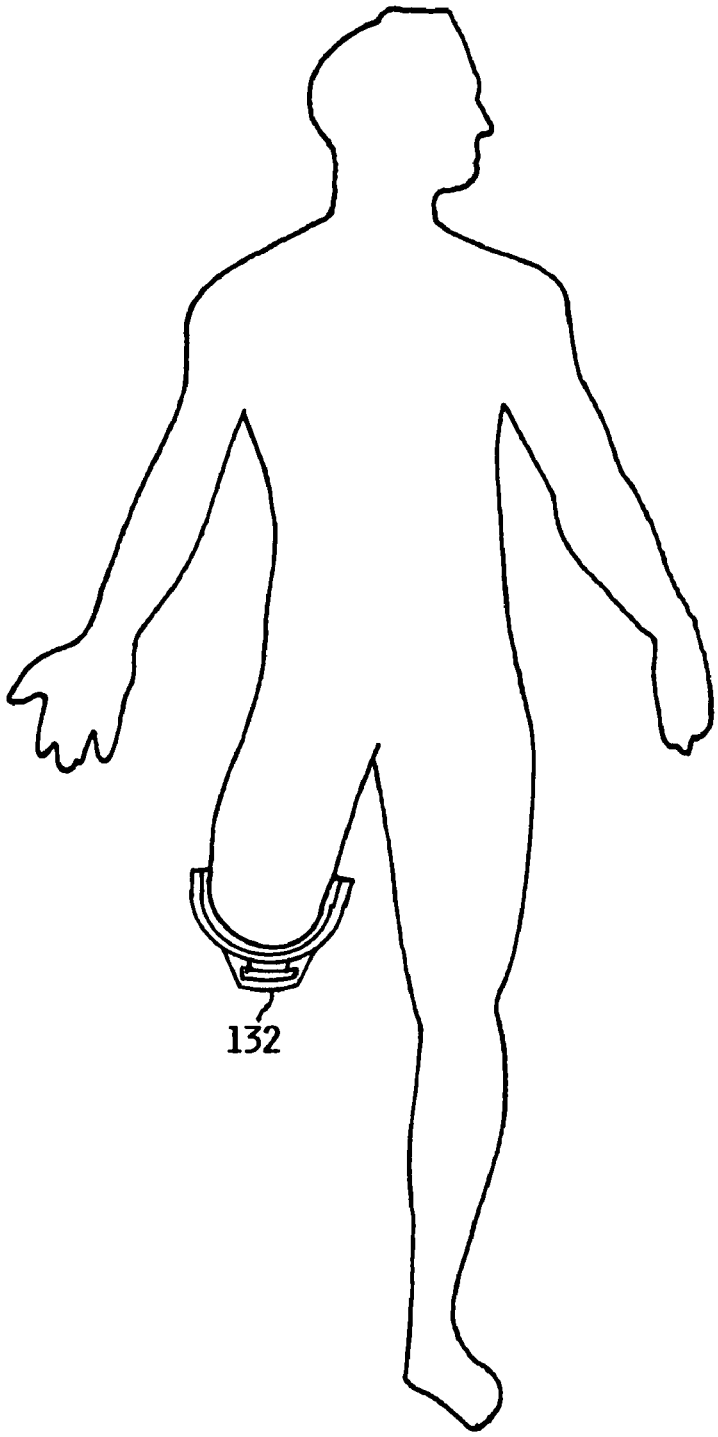
FIG. 19A is a front view of a patient having a leg mounted tactile prosthesis.
Figure 19B:
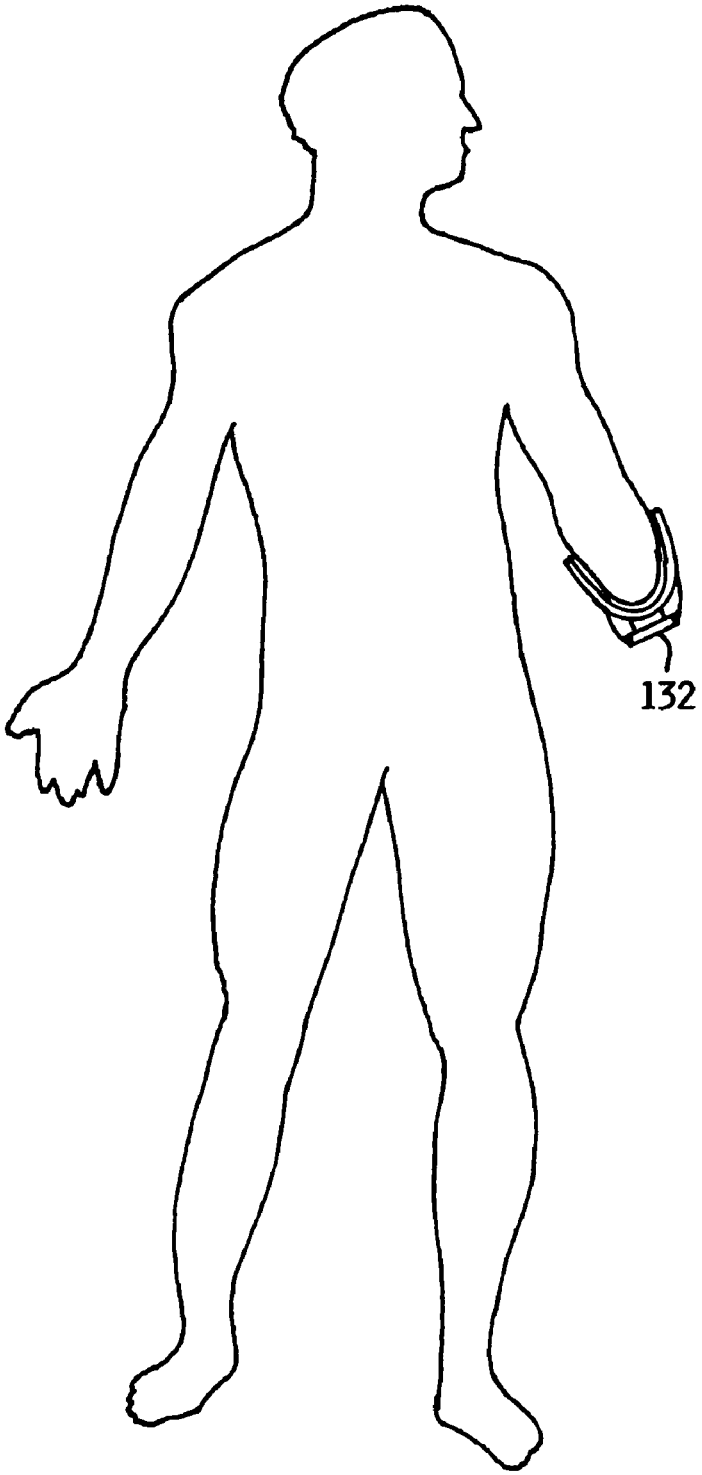
FIG. 19B is a front view of a patient having an arm mounted tactile prosthesis.

In some representative embodiments, speaker 10 can be adapted for use with a prosthesis 130 to form a tactile prosthesis 132 as illustrated in FIG. 19. Prosthesis 130 can be configured for any of a variety of attachment points including, for example, a patient's leg as depicted in FIG. 19A or a patient's arm as depicted in FIG. 19B. Prosthesis 130 can comprise a prosthesis wall 134 and an attachment point 136. Attachment point 136 can comprise an open and/or threaded portion for operably coupling prosthetic attachments to, for example, an arm or leg.

Speaker 10 can be operably coupled to the prosthesis 130 in any of a variety of locations based upon factors such as prosthesis type and patient sensitivity and comfort. In some instances, patients may exhibit increased sensitivity and pain sensation at the lower surgical area making a speaker side mount configuration especially desirable. As illustrated in FIG. 19, a first speaker side mount configuration 138A can comprise speaker 10 retained on prosthesis wall 134 such that touchpad 24 is in direct contact with prosthesis wall 134. Alternatively, speaker side mount configuration 138B can include forming a speaker cavity 140 in the prosthesis wall 134 allowing speaker 10 to be placed and mounted within the prosthesis wall 134 such that touchpad 24 is in direct contact with a prosthetic sock, liner or alternatively, the patient's skin, resulting in greater sensitivity of the transmitted vibrations. Speaker 10 can be detachably mounted either on the exterior of prosthesis wall 134 or within the speaker cavity 140 using suitable connectors 139 such as, for example, screws or hook and loop style straps. In yet another alternative mounting configuration, speaker 10 can operably connected at the attachment portion 136 using a speaker connector 137 that is integral to speaker 10.

Figure 20:
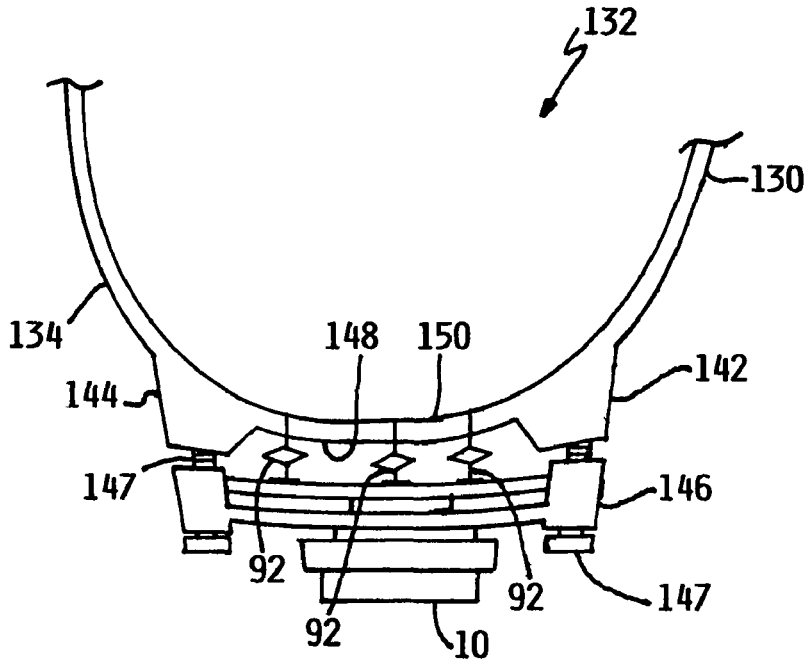
FIG. 20 is a section view of an embodiment of a tactile prosthesis utilizing an inner surface of a prosthesis wall as a touchpad for communicating vibrations to a patient.

In yet another embodiment, tactile prosthesis 132 can be formed to include a speaker mounting assembly 142 for attaching speaker 10 to prosthesis wall 134 as illustrated in FIG. 20. Speaker mounting assembly 142 can include a prosthetic mount support 144 integral to prosthesis wall 134 and an exterior support housing 146 for retaining the speaker 10. Prosthetic mount support 144 and exterior support housing 146 can be operably connected using suitable connectors 147 such as, for example, bolts, screws and the like. Due to the unique size and shape of individual prosthetics, speaker mounting assembly 142 can allow designers to custom fit and adapt speaker 10 so as to optimize vibration transmission from the speaker cone. An exterior surface 148 on prosthesis wall 134 can be cut such that one or more of the vibration transmission spring recoil connectors 92 can be attached between speaker cone 14 and an interior surface 150 of the prosthesis wall 134. In this way, interior surface 150 acts essentially as touchpad 24 and communicates the transmitted vibrations directly to the skin of the patient. In order to accommodate the variations in size and shape of each prosthesis, the one or more vibration transmission spring recoil connectors 92 can be clipped and subsequently adhesively joined to the interior surface 150.

Figure 21:
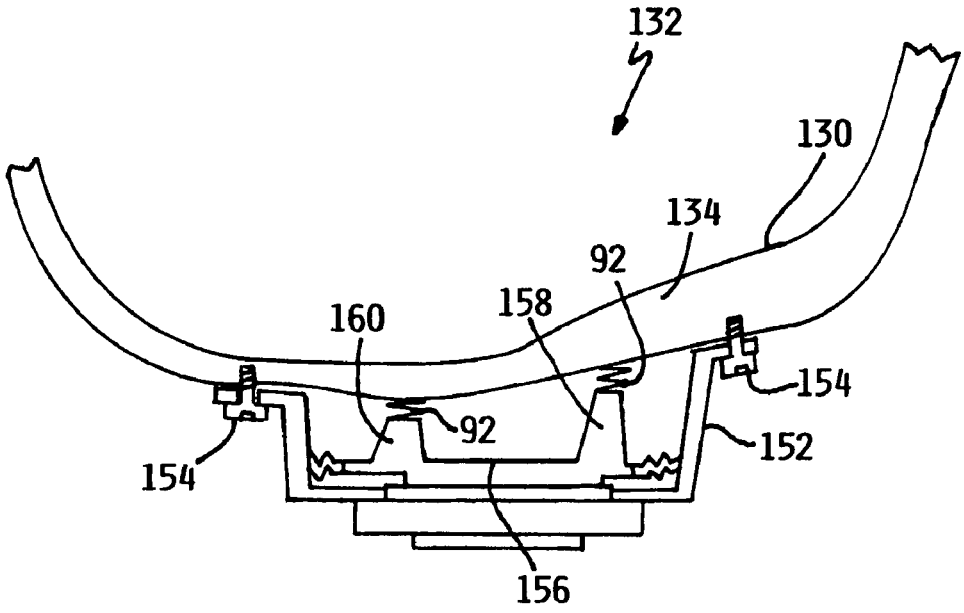
FIG. 21 is a section view of an embodiment of a tactile prosthesis having a sculpted speaker cone for transmitting vibrations to a patient.

Referring to FIG. 21, another representative embodiment of tactile prosthesis 132 can comprise a speaker transducer housing 152 mounted directly to the prosthesis wall 134 with connects 154 such as, for example, screws or bolts. Within speaker transducer housing 152, speaker 10 can include a sculpted speaker cone 156 having a plurality of different sized formed cones such as a high formed cone 158 and a low formed cone 160. The profile of sculpted speaker cone 156, and consequently the height of high formed cone 158 and low formed cone 160, can be selected to accommodate the size and shape of the tactile prosthesis such that the high formed cone 158 and low formed cone 160 more closely approximate the contour of the the prosthesis wall 134 are vibration transmission spring recoil connectors 92 for transmitting vibrations from sculpted speaker cone 156 to the prosthesis wall 134, which consequently takes the place of touchpad 24. In some embodiments, the vibration transmission spring recoil connectors 92 can be integrally formed with the high formed cone 158 and low formed cone 160 or alternatively, the vibration transmission spring recoil connectors 92 can be adhesively bonded between the sculpted speaker cone 156 and the prosthesis wall 134. Sculpted speaker cone 156 not only allows for the use of speaker 10 with unique, custom prosthesis configurations but can also provide sound engineers with new tools for providing unique and custom audio transmission techniques.

The invention may be embodied in other specific forms without departing from the essential attributes thereof; therefore, the illustrated embodiments should be considered in all respects as illustrative and not restrictive.

The invention claimed is:

1. A tactile sound speaker comprising:

a speaker having a speaker driver and a speaker cone;

at least three vibration transmitter shafts; and at least one touchpad, wherein each vibration transmitter shaft is operably coupled between the speaker cone and the touchpad such that sound generated by the speaker driver is transmitted to the touchpad as vibrations through the at least one vibration transmitter shaft.

2. The tactile sound speaker of claim 1, wherein the at least one touchpad includes a plurality of differently configured touchpads.

3. The tactile sound speaker of claim 2, wherein the plurality of differently configured touchpads can include one or more a hand touchpad and a foot touchpad.

4. The tactile sound speaker of claim 2, wherein each vibration transmitter shaft includes a vibration transmission spring recoil connector for varying cone recoil and cone flexibility.

5. The tactile sound speaker of claim 1, wherein each vibration transmitter shaft is integrally formed with the speaker cone.

6. The tactile sound speaker of claim 1, wherein the at least one touchpad includes a removable cover, said removable cover being washable or replaceable for use by multiple users.

7. The tactile sound speaker of claim 1, wherein the at least one touchpad includes a heat element for selectively regulating a temperature of the at least one touchpad.

8. The tactile sound speaker of claim 1, wherein the at least one touchpad includes a light source for providing a visual output in conjunction with the vibrations generated by the speaker driver.

9. The tactile sound speaker of claim 1, wherein the speaker is fully enclosed within a housing, and the at least one touchpad is attached to the housing with a gasket.

10. The tactile sound speaker of claim 1, wherein at least a portion of the speaker and at least one touchpad is embedded within an object selected from the group consisting of: a piece of furniture, a toy and a game.

11. A prosthesis comprising the tactile sound speaker of claim 1.

12. The prosthesis of claim 11, wherein the tactile sound speaker includes the speaker cone includes a plurality of different sized cones forming a sculpted speaker cone adapted to closely approximate a prosthesis wall contour.

13. A method for providing a tactile sound experience to a user comprising:

providing a tactile sound speaker having a speaker driver, a speaker cone, at least three vibration transmitter shafts and at least one touchpad;

transmitting a sound generated by the speaker driver as vibrations to the touchpad through the at least three vibration transmitter shafts;

interfacing the user with the touchpad to communicate the vibrations to the user.

14. The method of claim 13, further comprising:

muting an audio output from the tactile sound speaker such that the vibrations are the only output of the tactile sound speaker.

15. The method of claim 13, further comprising:

embedding the tactile sound speaker touchpad within an object selected from the group consisting of: a piece of furniture, a toy and a game.

16. The method of claim 13, further comprising:

encasing the touchpad within a removable prophylactic so as to allow for use by multiple users in a clinical or therapeutic environment.

17. The method of claim 13, further comprising:

attaching the tactile sound speaker directly to a prosthesis.

18. The method of claim 17, further comprising:

sculpting the speaker cone with a plurality of differently sized cones such that a sculpted speaker cone profile approximates a prosthesis wall contour.

19. The method of claim 13, further comprising:

forming each vibration transmitter shaft to include a vibration transmission spring recoil connector; and varying cone recoil and cone flexibility with the vibration transmission spring recoil connectors.

* * * * *